US006144144A

United States Patent [19]

Cleeves et al.

[11] Patent Number: 6,144,144

[45] Date of Patent: Nov. 7, 2000

[54] PATTERNED RESISTOR SUITABLE FOR ELECTRON-EMITTING DEVICE

[75] Inventors: James M. Cleeves, Redwood City; Christopher J. Spindt, Menlo Park; Roger W. Barton, Palo Alto; Kishore K. Chakravorty, San Jose; Arthur J. Learn, Cupertino; Stephanie J. Oberg, Sunnyvale, all of Calif.

[73] Assignee: Candescent Technologies Corporation, San Jose, Calif.

[21] Appl. No.: 08/962,230

[22] Filed: Oct. 31, 1997

[51] Int. Cl.[7] ..... H01J 1/30

[52] U.S. Cl. ..... 313/309; 313/336; 313/351; 313/495; 313/497

[58] Field of Search ..... 313/309, 336, 313/351, 308, 495, 497

[56] References Cited

U.S. PATENT DOCUMENTS

| | | | |
|---|---|---|---|
| 4,940,916 | 11/1990 | Borel et al. | 315/306 |
| 5,142,184 | 8/1992 | Kane | 313/309 |
| 5,162,704 | 11/1992 | Kobori et al. | 315/349 |
| 5,194,780 | 3/1993 | Meyer | 315/169.3 |
| 5,458,520 | 10/1995 | DeMercurio et al. | 445/24 |
| 5,534,744 | 7/1996 | Leroux | 313/309 |
| 5,559,389 | 9/1996 | Spindt et al. | 313/310 |
| 5,564,959 | 10/1996 | Spindt et al. | 445/24 |
| 5,569,975 | 10/1996 | Taylor et al. | 313/310 |
| 5,574,333 | 11/1996 | Clerc | 313/497 |
| 5,587,623 | 12/1996 | Jones | 313/497 |
| 5,592,056 | 1/1997 | Peyre et al. | 315/169.1 |
| 5,594,298 | 1/1997 | Itoh et al. | 313/336 |
| 5,619,097 | 4/1997 | Jones | 313/495 |
| 5,672,933 | 9/1997 | Wilson et al. | 313/336 |
| 5,828,163 | 10/1998 | Jones et al. | 313/336 |

*Primary Examiner*—Ashok Patel
*Attorney, Agent, or Firm*—Skjerven, Morrill, MacPherson, Franklin & Friel LLP; Ronald J. Meetin

[57] ABSTRACT

An electron-emitting device contains a vertical emitter resistor patterned into multiple laterally separated sections (34, 34V, 46, or 46V) situated between the electron-emissive elements (40), on one hand, and emitter electrodes (32), on the other hand. Sections of the resistor are spaced apart along each emitter electrode.

52 Claims, 10 Drawing Sheets

PATTERNED RESISTOR SUITABLE FOR ELECTRON-EMITTING DEVICE

FIELD OF USE

This invention relates to resistors. More particularly, this invention relates to the structure and fabrication of an electron-emitting device in which electrically resistive material is situated between electron-emissive elements, on one hand, and emitter electrodes, on the other hand, and which is suitable for use in a flat-panel display of the cathode-ray tube ("CRT") type.

BACKGROUND

A flat-panel CRT display basically consists of an electron-emitting device and a light-emitting device that operate at low internal pressure. The electron-emitting device, commonly referred to as a cathode, contains electron-emissive elements that emit electrons over a wide area. The emitted electrons are directed towards light-emissive elements distributed over a corresponding area in the light-emitting device. Upon being struck by the electrons, the light-emissive elements emit light that produces an image on the viewing surface of the display.

When the electron-emitting device operates according to field-emission principles, electrically resistive material is commonly placed in series with the electron-emissive elements to control the magnitude of current flow through the electron-emissive elements. FIG. 1 illustrates a conventional field-emission device, as described in U.S. Pat. No. 5,564,959, that so utilizes resistive material. In the field emitter of FIG. 1, electrically resistive layer 10 overlies emitter electrodes 12 provided on baseplate 14. Control (or gate) electrodes 16, one of which is depicted in FIG. 1, are situated on dielectric layer 18 and cross over emitter electrodes 12. Conical electron-emissive elements 20 are situated on emitter resistive layer 10 in openings 22 through dielectric layer 18 and are exposed through corresponding openings 24 in control electrodes 16.

Resistive layer 10 is typically a blanket resistor. That is, resistor 10 extends in a continuous manner over the emitter electrodes 12 and the intervening portions of baseplate 14. Consequently, each electron-emissive element 20 is electrically coupled through resistive layer 10 to each other element 20.

The resistance of layer 10 is usually sufficiently high that the intercoupling of electron-emissive elements 20 through layer 10 has little effect on the display operation. In fact, layer 10 is normally of such high resistance that layer 10 effectively electrically isolates each element 20 from each other element 20. Nonetheless, some undesirable leakage current flows between elements 20 due to the intercoupling provided by resistive layer 10.

It is desirable to have a resistive layer that provides resistance at selected areas along baseplate 14 but does not itself electrically interconnect these areas. In this regard, electron-emissive elements 20 at each location where one control electrode 16 crosses over one emitter electrode 14 operate as a unit and need not be resistively separate. It is also desirable to configure the resistive layer in such a way that underlying emitter electrodes be externally electrically accessible along their upper surfaces without the necessity of performing a separate etching operation to cut openings through the resistive layer. Furthermore, it is preferable to provide a suitable pattern in the resistive layer without employing any additional masking steps beyond those used for patterning other components in the field emitter.

GENERAL DISCLOSURE OF THE INVENTION

The present invention furnishes an electron-emitting device having a resistive layer patterned to meet the foregoing needs. The present resistive layer contains multiple laterally separated sections situated between electron-emissive elements, on one hand, and emitter electrodes, on the other hand. The sections of the resistive layer are spaced apart along each emitter electrode.

The resistive sections underlie control electrodes of the present electron-emitting device in various ways. In one general embodiment, the resistive sections are basically configured as resistive strips situated below the control electrodes. Each resistive strip is sufficiently long to extend over at least two, typically all, of the emitter electrodes.

In another general embodiment of the resistive layer, the resistive sections are basically configured as resistive portions spaced apart below each control electrode and above each emitter electrode. As viewed in the vertical direction, the resistive portions are roughly centered at the locations where the control electrodes cross over the emitter electrodes. As contrasted to the first-mentioned embodiment in which each resistive strip extends over two or more of the emitter electrodes, each resistive portion in this embodiment extends over only one of the emitter electrodes.

To manufacture an electron-emitting device that employs the resistive layer of the invention, a structure is typically first provided in which a control electrode overlies a dielectric layer that overlies an electrically resistive layer overlying an emitter electrode. An electron-emissive element is situated in a composite opening extending through the control electrode and dielectric layer in the structure so that the electron-emissive element overlies the resistive layer above the emitter electrode. Creation of the resistive sections involves removing portions of the resistive layer located generally below spaces situated to the sides of the control electrode.

The removing step is normally performed by etching the resistive layer through a mask formed at least partially with the control electrode. By utilizing this technique, there is typically no need to perform a separate masking step in order to pattern the resistive layer into separate sections along the emitter electrode. Also, in the embodiment where portions of the resistive layer are spaced laterally apart below the control electrode, the resistive layer can be initially patterned using the mask typically employed in patterning an emitter layer to form the emitter electrode. Again, there is no need to perform an extra masking step to provide this initial patterning to the resistive layer. The net result is that the desired pattern can be provided in the resistive layer without increasing the number of masking steps.

In some applications, a separate masking step may be employed in providing the requisite pattern in the resistive layer. Use of a separate masking step may arise as a matter of process convenience or due to overall processing constraints. Regardless of whether a separate masking step is, or is not, utilized in patterning the resistive layer, parts of the upper surfaces of the emitter electrodes are not covered by the resistive layer. Consequently, external electrical contacts can be made to the upper surfaces of the emitter electrodes without the necessity to perform a separate operation to cut openings through the resistive layer. Fabrication of the present resistor is highly economical.

BRIEF DESCRIPTION OF THE DRAWINGS

FIGS. 8*a*–8*m* are taken through plane 8—8 in FIGS. 9*a*–9*m*. FIGS. 9*a*–9*m* are taken through plane 9—9 in FIGS. 8*a*–8*m*.

FIGS. 8*d*–8*m* present steps that follow those of FIGS. 12*a*–12*c* in manufacturing this embodiment of the electron-emitting device of FIGS. 5–7.

FIGS. 12*a*–12*c* are taken through plane 12—12 in FIGS. 13*a*–13*c*. FIGS. 8*d*–8*m* are taken through plane 8—8 in FIGS. 13*d*–13*m*. FIGS. 13*a*–13*m* are taken through plane 13—13 in FIGS. 12*a*–12*c* and 8*d*–8*m*, plane 13—13 being at the same location as plane 9—9.

Like reference symbols are employed in the drawings and in the description of the preferred embodiments to represent the same, or very similar, item or items.

DESCRIPTION OF THE PREFERRED EMBODIMENTS

In the present invention, a vertical resistor connected in series with electron-emissive elements of an electron-emitting device is patterned into multiple sections laterally separated along each emitter electrode in the device. The electron emitter of the invention typically operates according to field-emission principles in producing electrons that cause visible light to be emitted from corresponding light-emissive phosphor elements of a light-emitting device. The combination of the electron-emitting device, often referred to as a field emitter, and the light-emitting device forms a cathode-ray tube of a flat-panel display such as a flat-panel television or a flat-panel video monitor for a personal computer, a lap-top computer, or a workstation.

In the following description, the term "electrically insulating" (or "dielectric") generally applies to materials having a resistivity greater than $10^{10}$ ohm-cm. The term "electrically non-insulating" thus refers to materials having a resistivity less than or equal to $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. These categories are determined at an electric field of no more than 1 volt/$\mu$m.

Examples of electrically conductive materials (or electrical conductors) are metals, metal-semiconductor compounds (such as metal silicides), and metal-semiconductor eutectics. Electrically conductive materials also include semiconductors doped (n-type or p-type) to a moderate or high level. The semiconductors may be of the monocrystalline, multicrystalline, polycrystalline, or amorphous type.

Electrically resistive materials include (a) metal-insulator composites such as cermet, (b) certain silicon-carbon compounds such as silicon carbide and silicon-carbon-nitrogen, (c) forms of carbon such as graphite, amorphous carbon, and modified (e.g., doped or laser-modified) diamond, and (d) semiconductor-ceramic composites. Further examples of electrically resistive materials are intrinsic and lightly doped (n-type or p-type) semiconductors.

As used below, an upright trapezoid is a trapezoid whose base (a) extends perpendicular to the direction taken as the vertical, (b) extends parallel to the top side, and (c) is longer than the top side. A transverse profile is a vertical cross section through a plane perpendicular to the length of an elongated region. The row direction in a matrix-addressed field emitter for a flat-panel display is the direction in which the rows of picture elements (pixels) extend. The column direction is the direction in which the columns of pixels extend and runs perpendicular to the row direction.

Figure 1:
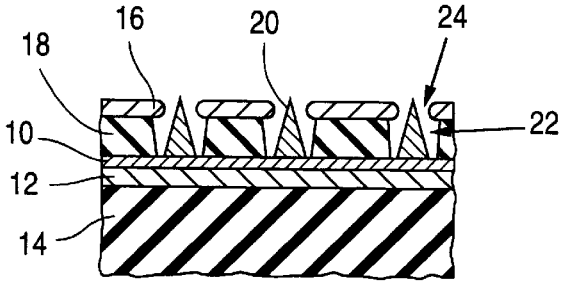
Fig. 1 PRIOR ART
FIG. 1 is a cross-sectional view of the core of a conventional electron-emitting device.
Figure 2:
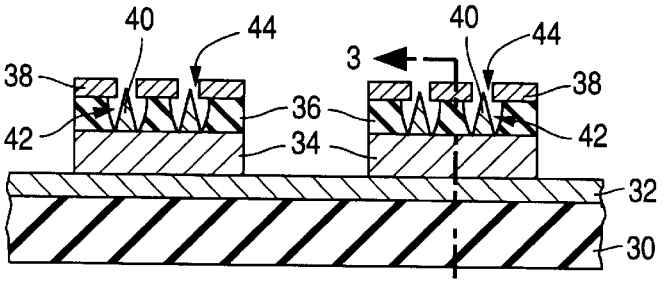
FIGS. 2 and 3 are cross-sectional structural views of the core of an electron-emitting device provided with a vertical emitter resistor patterned in accordance with the invention. The cross section of FIG. 2 is taken through plane 2—2 in FIG. 3. The cross section of FIG. 3 is taken through plane 3—3 in FIG. 2.
Figure 3:
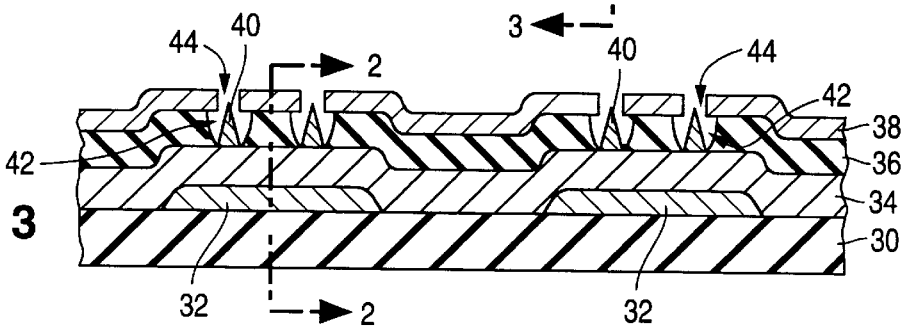
Figure 4:
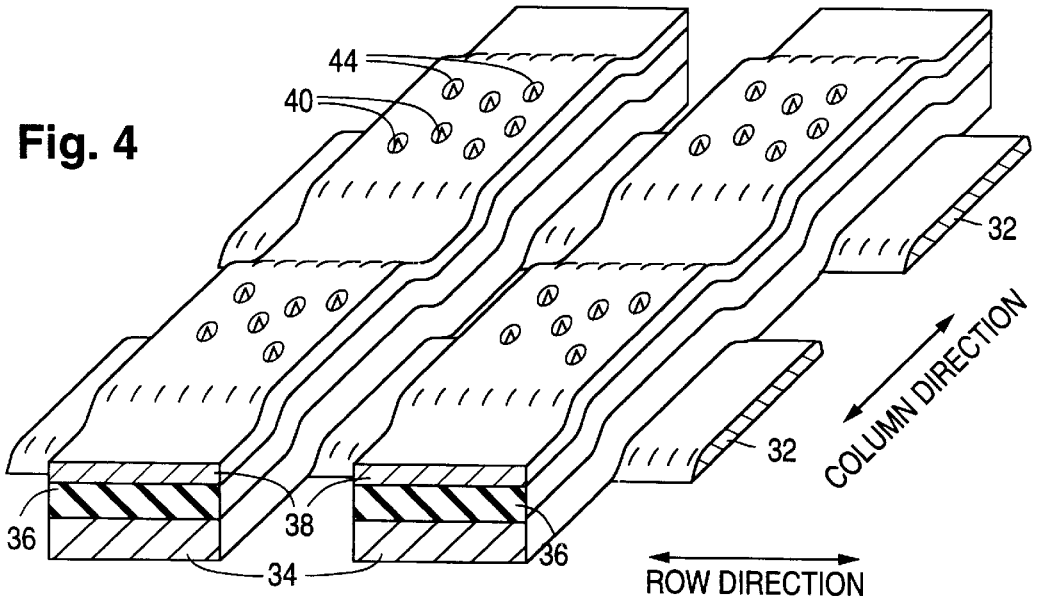
FIG. 4 is a perspective view of the electron-emitting device of FIGS. 2 and 3.

FIGS. 2–4 illustrate the core of a matrix-addressed field emitter that contains a vertical emitter resistor patterned into resistor strips in a vertically aligned manner according to the invention. The cross sections of FIGS. 2 and 3 are taken through perpendicular planes. The field emitter of FIGS. 2–4 is created from a flat electrically insulating baseplate (substrate) 30 typically consisting of glass such as Schott D263 glass having a thickness of approximately 1 mm. To simplify the pictorial illustration, baseplate 30 is not shown in the perspective view of FIG. 4.

A group of generally parallel emitter electrodes 32 are situated on baseplate 30. Emitter electrodes 32 extend in the row direction and constitute row electrodes. As shown in FIGS. 3 and 4, each emitter electrode 32 has a transverse profile roughly in the shape of an upright isosceles trapezoid. The acute angle in the trapezoidal profile is 5–75°, preferably 15°. This profile helps improve step coverage of layers formed above emitter electrodes 32.

Emitter electrodes 32 typically consist of aluminum, nickel, or chromium, or an alloy of any of these metals. In the aluminum case, emitter electrodes 32 are typically 0.1–0.5 μm in thickness. Alternatively, each emitter electrode 32 can be formed with an aluminum layer whose top surface is coated with a thin layer (not shown) of metal, such as tantalum, that bonds well to materials used for making external electrical connections to the top surfaces of electrodes 32. An anodic layer of metal oxide (likewise not shown) may lie along the sidewalls of each electrode 32.

A patterned electrically resistive layer consisting of a group of laterally separated generally parallel strips 34 is situated on top of emitter electrodes 32 and extends down to baseplate 30 in the spaces between electrodes 32. Resistive strips 34 extend in the column direction and are spaced apart along each emitter electrode 32. Each resistive strip 34 extends over all of electrodes 32. Consequently, strips 34 overlie laterally separated parts of each electrode 32. Strips 34 are vertical resistors in that current flows through strips 34 largely in the vertical direction between electrodes 32 and the overlying electron-emissive elements described below.

Each of resistive strips 34 typically consists of a lower layer of a silicon-carbon-nitrogen compound and an upper layer of cermet. The thickness of the lower silicon-carbon-nitrogen layer is 0.1–0.4 μm, typically 0.3 μm. The thickness of the upper cermet layer is 0.01–0.1 μm, typically 0.05 μm. Alternatively, each resistive strip 34 can be a single layer consisting substantially, for example, of cermet or a silicon-carbon-nitrogen compound. In any event, each strip 34 provides a vertical resistance of $10^6$–$10^{10}$ ohms, typically $10^9$ ohms, between the underlying portions of emitter electrodes 32 and the overlying electron-emissive elements.

A patterned dielectric layer consisting of a group of laterally separated generally parallel strips 36 overlies resistive strips 34. Each dielectric strip 36 lies fully on a corresponding one of resistive strips 34. The longitudinal side edges of each dielectric strip 36 are in approximate vertical alignment with the longitudinal side edges of corresponding resistive strip 34. Dielectric strips 36 typically consist of silicon oxide having a thickness of 0.1–0.4 μm.

A group of generally parallel control electrodes 38 overlie dielectric strips 36 above resistive strips 34. Each control electrode 38 lies on the entire top surface of a corresponding one of dielectric strips 36 and, accordingly, fully overlies underlying resistive strip 34. Due to the characteristics of the etch procedures typically used to define the longitudinal side edges of strips 34 and 36, each control electrode 38 may be slightly wider than underlying dielectric strip 36 and/or underlying resistive strip 34. That is, control electrodes 38 may slightly overlap strips 34 and 36. Taking this small overlap into account, the longitudinal side edges of each control electrode 38 are in approximate vertical alignment with the longitudinal side edges of corresponding dielectric strip 36 and thus are in approximate vertical alignment with the longitudinal edges of corresponding resistive strip 34. As with strips 34 and 36, electrodes 38 extend in the column direction. Hence, electrodes 38 are column electrodes.

Control electrodes 38 may be configured in various ways. For example, each electrode 38 can be implemented as a main control portion and one or more thinner adjoining gate portions as described below in connection with FIGS. 8*a*–8*m* and 9*a*–9*m*. The main control portions extend the full length of electrodes 38. Each gate portion spans (i.e., extends fully across) a main control opening in the adjoining main control portion. In such an embodiment, the principal constituent of the main control portions is typically chromium having a thickness of 0.3 μm. Alternatively, the principal constituent of the main control portions can be aluminum whose thickness is 0.1 μm. In that case, a coating of a metal, such as tantalum, may cover the top surface of the aluminum in each main control portion to facilitate making external electrical connections to the top surfaces of the main control portions. An anodic layer of metal oxide (not shown) may lie along the sidewalls of each main control portion. The gate portions typically consist of chromium having a thickness of 0.04 μm.

An array of rows and columns of laterally separated sets of electron-emissive elements 40 are situated on top of resistive strips 34 in composite openings extending through dielectric strips 36 and column electrodes 38. Each composite opening consists of (a) a dielectric opening 42 extending through one of dielectric strips 36 and (b) a control opening 44 extending through overlying control electrode 38. The top of dielectric opening 42 in each composite opening 42/44 is typically wider than its control opening 44.

Each of the sets of electron-emissive elements 40 normally consists of multiple elements 40. Electron-emissive elements 40 in each different set contact a portion of a resistive strip 34 at the location where corresponding control electrode 38 crosses over an emitter electrode 32. Each set of elements 40 is electrically coupled through underlying resistive strip 34 to underlying emitter electrode 32. Consequently, the sets of elements 40 in each row of the electron-emissive-element sets are respectively electrically coupled through the underlying portions of all resistive strips 34 to underlying emitter electrode 32. On the other hand, the sets of elements 40 in each column of the electron-emissive-element sets are electrically coupled through portions of underlying resistive strip 34 respectively to all of emitter electrodes 32.

The electron-emissive elements 40 are typically conical in shape, as depicted in FIGS. 2–4. In this case, the principal constituent of elements 40 is typically molybdenum. Elements 40 can be shaped differently, for example, as filaments or as cones on pedestals. Dielectric openings 42 may then be shaped differently from what is generally indicated in FIGS. 2–4.

During field emitter operation, the voltages on electrodes 32 and 38 are controlled in such a way that control electrodes 38 extract electrons from electron-emissive elements 40 in selected ones of the electron-emissive-element sets. An anode in the light-emitting device (not shown here) situated opposite elements 40 draws the extracted electrons towards light-emissive elements located close to the anode. As electrons are emitted by each activated electron-emissive element 40, a positive current flows through underlying resistive strip 34 to underlying emitter electrode 32.

Resistive strips 34 provide the field emitter with electron emission uniformity and short circuit protection. Specifically, strips 34 limit the maximum current that can flow through activated electron-emissive elements 40. Since the positive current flowing through each activated element 40 equals the electron current supplied by that element 40, strips 34 limit the number of electrons emitted by activated elements 40. This prevents some of elements 40 from providing many more electrons than other of elements 40 at the same extraction voltage and thus prevents undesirable bright spots from occurring on the viewing surface of the flat-panel display.

Also, if one of control electrodes 38 becomes electrically shorted to underlying resistive strip 34 and thus becomes electrically coupled to underlying emitter electrode 32, resistive strip 34 at the short circuit location significantly limits the current flowing through the short circuit connection. The vertical resistance of strip 34 at the short circuit location is so high that substantially all of the normal voltage drop between electrodes 38 and 32 at the short circuit location occurs across the intervening portion of resistive strip 34. With proper electron-emitter design, the presence of the short circuit does not detrimentally affect the operation of any of the other sets of electron-emissive elements 40.

Such a short circuit can arise by way of a conductive path created through a dielectric strip 36 or by having one or more of electron-emissive elements 40 come into contact with their control electrode 38. In the case of a control-electrode-to-electron-emissive-element short circuit, each shorted electron-emissive element 40 is normally defective. However, resistive strips 34 limit the current through each shorted element 40 sufficiently that non-shorted elements 40 in that set of electron-emissive elements normally still operate in the intended manner. Resistive strips 40 thus normally enable a set of electron-emissive elements 40 containing a small percentage of shorted elements 40 to perform the intended electron-emitting function in an adequate manner. Electron-emission uniformity is substantially maintained.

Figure 5:
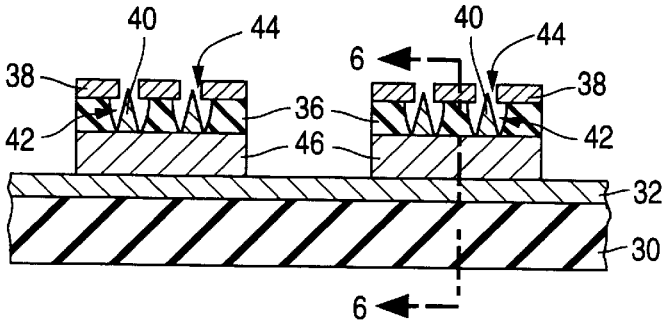
FIGS. 5 and 6 are cross-sectional structural views of the core of an electron-emitting device provided with another vertical emitter resistor patterned in accordance with the invention. The cross section of FIG. 5 is taken through plane 5—5 in FIG. 6. The cross section of FIG. 6 is taken through plane 6—6 in FIG. 5.
Figure 6:
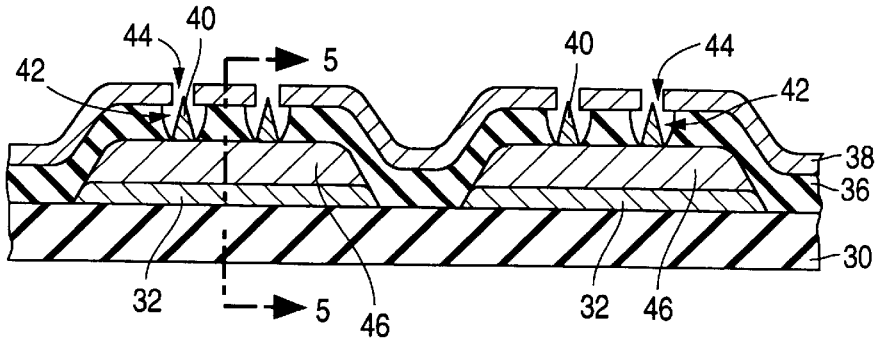
Figure 7:
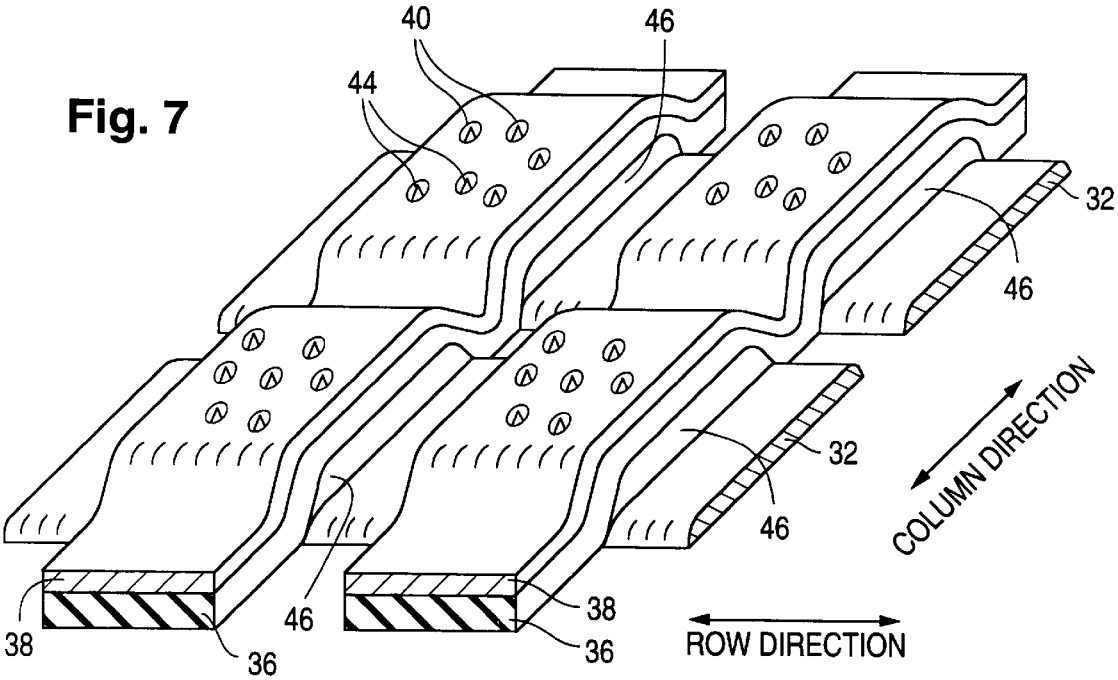
FIG. 7 is a perspective view of the electron-emitting device of FIGS. 5 and 6.
Figure 9A:
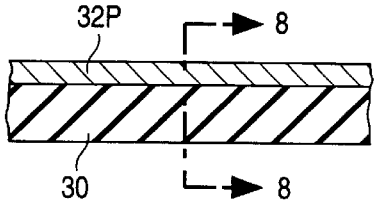
FIGS. 9*a*–9*m* are further cross-sectional structural views respectively corresponding to FIGS. 8*a*–8*m*.

Turning to FIGS. 5–7, they illustrate the core of another matrix-addressed field emitter that contains a vertical emitter resistor patterned into resistive portions in a vertically aligned manner according to the invention. The cross sections of FIGS. 5 and 6 are taken through perpendicular planes. The field emitter of FIGS. 5–7 is the same as that of FIGS. 2–4 except that the patterned resistor is configured in an array of rows and columns of laterally separated portions 46 rather than being configured into resistive strips 34. In addition to resistive portions 46, the field emitter of FIGS. 5–7 contains components 30, 32, 36, 38, and 40. As with the perspective view of FIG. 4, baseplate 30 is not shown in the prospective view of FIG. 7.

In the field emitter of FIGS. 5–7, resistive portions 46 are situated fully on emitter electrodes 32. Accordingly, dielectric strips 36 extend down to baseplate 30 in the spaces between electrodes 32. Each resistive portion 46 has row-direction side edges in approximate vertical alignment with (portions of) the longitudinal side edges of a corresponding one of underlying electrodes 32. Similar to resistive strips 34, resistive portions 46 in each row of portions 46 are laterally separated along underlying electrode 32. The constituency of resistive portions 46 is normally the same as that of resistive strips 34.

Resistive portions 46 fully underlie dielectric strips 36 below control electrodes 38. Specifically, each column of resistive strips 46 is laterally separated along a corresponding one of overlying dielectric strips 36 and thus along the corresponding one of overlying electrodes 38. The longitudinal side edges of each control electrode 38 are again approximately vertically aligned with the longitudinal side edges of corresponding dielectric strip 36. Each resistive portion 46 has column-direction side edges in approximate vertical alignment with (portions of) the longitudinal side edges of corresponding dielectric strip 36 and thus in approximate vertical alignment with (the corresponding portions of) the longitudinal side edges of corresponding control electrode 38. In this regard, each control electrode 38 may extend slightly beyond underlying dielectric strip 36 in the row direction and/or slightly beyond each underlying resistive portion 46 in the row direction.

As FIGS. 6 and 7 depict, emitter electrodes 32 again have transverse profiles roughly in the shape of upright isosceles trapezoids. Resistive portions 46 have corresponding profiles roughly in the shape of upright isosceles trapezoids in vertical planes that extend in the column direction. The acute angles in the trapezoids for components 32 and 46 are 5–75°, preferably 15°. The base of the trapezoidal profile for each resistive portion 46 is of approximately the same length as the top side of the trapezoidal profile for underlying emitter electrode 32. Hence, each emitter electrode 32 is of longer column-direction trapezoidal base length than overlying resistive portions 46. By configuring components 32 and 46 in this manner, step coverage is improved in the layers formed above components 32 and 46.

Dielectric strips 36 and control electrodes 38 are more curved in the field emitter of FIGS. 5–7 than in the field emitter of FIGS. 2–4. This arises because resistive portions 46 fully overlie emitter electrodes 32 rather than extending down to baseplate 30 in the spaces between electrodes 32 as is the case with resistive strips 34. Aside from this difference and the others mentioned above, the field emitter of FIGS. 5–7 is configured and operates in substantially the same manner as that of FIGS. 2–4.

FIGS. 8*a*–8*m* and 9*a*–9*m* illustrate a process for manufacturing an embodiment of the field emitter of FIGS. 2–4. The structure shown in each FIG. 9*x*, where x varies from a to m, is taken through a plane perpendicular to the structure shown in corresponding FIG. 8*x*. The cross sections of FIGS. 8*a*–8*m* (collectively "FIG. 8") lead to an embodiment of the cross section of FIG. 2. The cross sections of FIGS. 9*a*–9*m* (collectively "FIG. 9") lead to an embodiment of the cross section of FIG. 3.

The starting point for the process of FIGS. 8 and 9 is baseplate 30. A blanket electrically non-insulating emitter layer 32P is formed on baseplate 30 as shown in FIGS. 8*a* and 9*a*. Emitter layer 32P is typically formed by sputtering aluminum, nickel, or chromium on baseplate 30.

A photoresist mask 50 bearing the general pattern intended for emitter electrodes 32 is formed on emitter layer 32P. See FIGS. 8*b* and 9*b*. Photoresist mask 50 has sidewalls that slope strongly outward in going from the upper photoresist surface to the lower photoresist surface. This sloping is typically achieved by baking photoresist 50 at a temperature above the glass transition temperature, thereby causing photoresist 50 to flow. The flow results in a sloped photoresist profile of the shape generally shown in FIG. 9*b*.

Figure 8A:
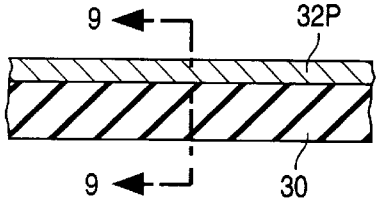
FIGS. 8*a*–8*m* are cross-sectional structural views representing steps in manufacturing an embodiment of the electron-emitting device of FIGS. 2–4 according to the invention.
Figure 8B:
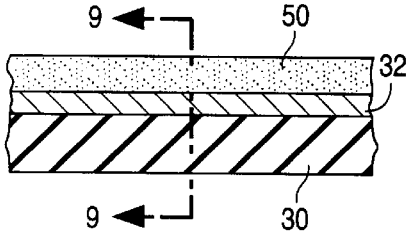
Figure 9B:
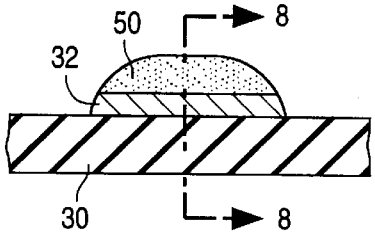

The exposed portions of layer 32P are removed in such a manner that the remainder of layer 32P constitutes emitter electrodes 32 having transverse profiles roughly in the shape of upright isosceles trapezoids. This patterning step typically entails etching the exposed material of layer 32P with etchant that attacks the photoresist of mask 50 at a rate quite high relative to the rate at which the etchant attacks the material of layer 32P. Accordingly, photoresist 50 is eroded laterally and vertically during the etch period. Due to the photoresist erosion, electrodes 32 are created with the indicated sloped sidewalls. FIGS. 8*b* and 9*b* illustrate the shape of photoresist 50 at the end of emitter-electrode patterning step, photoresist 50 having been larger at the beginning of the patterning step.

The emitter-electrode patterning step is normally performed with a plasma, typically a chlorine plasma. Alternatively, the emitter-electrode patterning can be done with a liquid chemical etchant. The adhesive strength of photoresist 50 to emitter layer 32P then controls the sidewall slope.

After removing photoresist 50, a sputter etch is optionally performed to clean the top surfaces of electrodes 32. A blanket electrically resistive layer 34P is then formed on top of emitter electrodes 32. See FIGS. 8*c* and 9*c*. Resistive layer 34P extends down to baseplate 30 in the spaces between electrodes 32.

Resistive layer 34P is typically deposited as a lower layer of a silicon-carbon-nitrogen compound and an upper layer of cermet. The techniques disclosed in Knall et al, U.S. patent application Ser. No. 08/884,702, filed Jun. 30, 1997, U.S. Pat. No. 6,013,986, are typically used to form layer 34P in this manner. Alternatively, a layer of cermet or a silicon-carbon-nitrogen compound can be deposited to form layer 34P. In either case, the formation of resistive layer 34P is typically accomplished by sputter deposition. Plasma-enhanced chemical vapor deposition can alternatively be employed to form layer 34P.

The field emitter is divided into (a) an active device region in which electron-emissive elements 40 are later formed and (b) a peripheral device region situated laterally outside the active device region. In order to examine the field emitter during fabrication, it may be desirable to electrically access emitter electrodes 32 along their top surfaces in the peripheral device region immediately after depositing resistive layer 34P. If so, layer 34P can be formed by selectively depositing the resistive material(s) using a shadow mask to prevent the resistive material(s) from accumulating in the peripheral-region sites where electrodes 32 are to be accessed. The shadow mask has deposition-blocking portions situated above these peripheral-region sites.

Figure 8C:
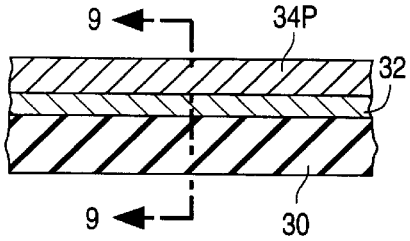
Figure 9C:
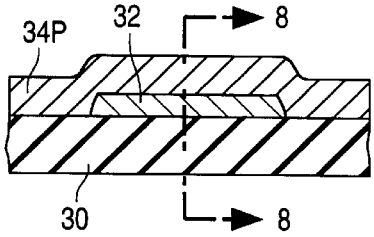
Figure 8D:
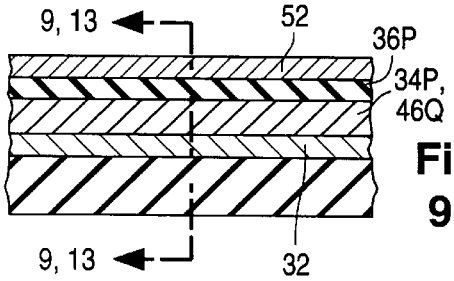
Figure 9D:
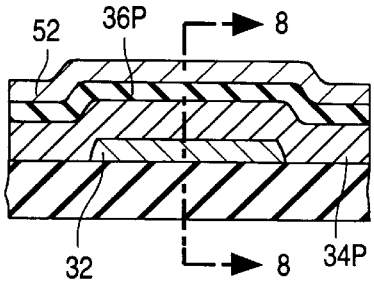

In any event, a blanket dielectric layer 36P is subsequently deposited on resistive layer 34P as shown in FIGS. 8*d* and 9*d*. Dielectric layer 36P typically consists of silicon oxide formed by chemical vapor deposition. A blanket electrically non-insulating main control layer 52 is formed on dielectric layer 36P as also shown in FIGS. 8*d* and 9*d*. Main control layer 52 is typically created by sputter depositing chromium or aluminum on dielectric layer 36P.

A photoresist mask 54 bearing the pattern intended for the main control portions is formed on main control layer 52. See FIGS. 8*e* and 9*e*. The exposed portions of layer 52 are removed with a chemical etchant. Alternatively, a plasma can be employed to remove the exposed portions of layer 52. The patterned remainder 52A of layer 52 consists of a group of laterally separated main control portions extending in the column direction.

An array of rows and columns of main control openings 56 extend through main control portions 52A down to dielectric layer 36P. One main control opening 56 is provided for each set of electron-emissive elements 40. In particular, one main control opening 56 is present at each location where a main control portion 52A crosses over an emitter electrode 32.

Figure 8E:
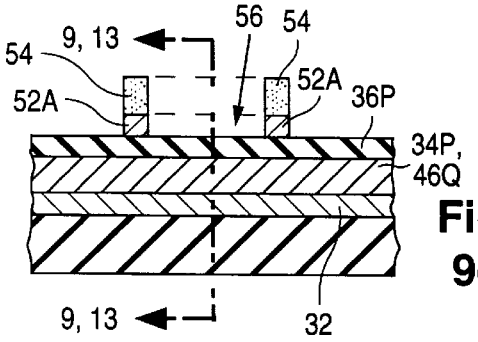
Figure 9E:
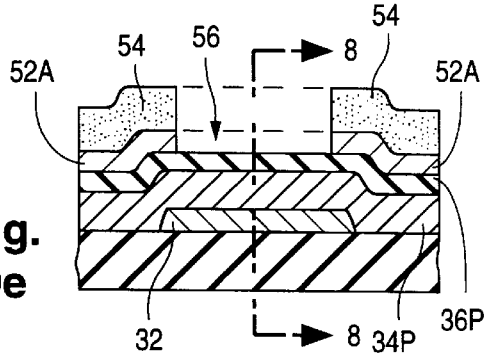
Figure 8F:
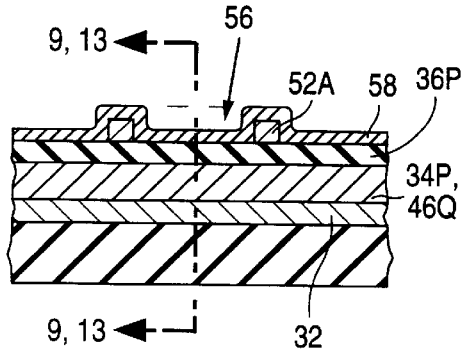
Figure 9F:
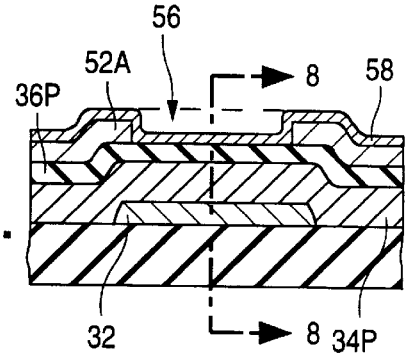

After removing photoresist 54, a blanket electrically non-insulating gate layer 58 is deposited, typically by sputtering, on top of the structure as shown in FIGS. 8*f* and 9*f*. Gate layer 58 lies on main control portions 52A and extends into main control openings 56 so as to fully span openings 56. Gate layer 58 typically consists of chromium. Alternatively, gate layer 58 can be created before creating main control portions 52A. In that case, portions 52A lie on top of layer 58.

Gate openings that implement control openings 44 are formed at multiple locations through each of the portions of gate layer 58 that span main control openings 56. See FIGS. 8*g* and 9*g*. Gate openings 44 are typically created according to a charged-particle tracking procedure of the type described in U.S. Pat. Nos. 5,559,389 or 5,564,959. Item 58A in FIGS. 8*g* and 9*g* indicates the remainder of gate layer 58.

Figure 8G:
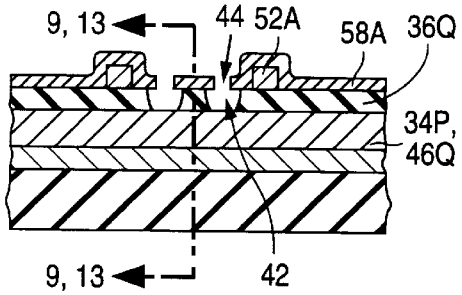
Figure 9G:
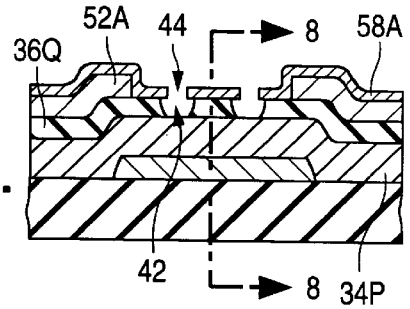

Using gate layer 58A as an etch mask, dielectric strips 36P are etched through gate openings 44 to form dielectric openings 42. FIGS. 8*g* and 9*g* show the resultant structure. Items 36Q are the remainders of dielectric strips 36P. The etch to create gate openings 44 is normally performed in such a manner that dielectric openings 42 undercut gate layer 58A somewhat. The amount of undercutting is sufficiently great to avoid having the layer-deposited emitter cone material accumulate on the sidewalls of dielectric openings 42 and electrically short electron-emissive elements 40 to the gate material.

Figure 8H:
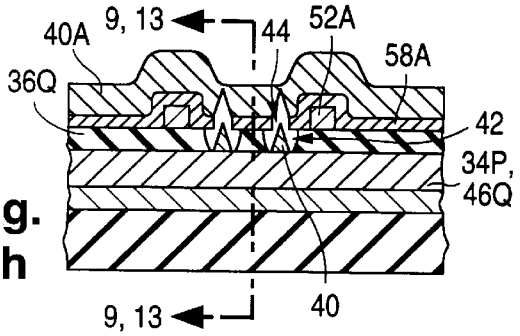
Figure 9H:
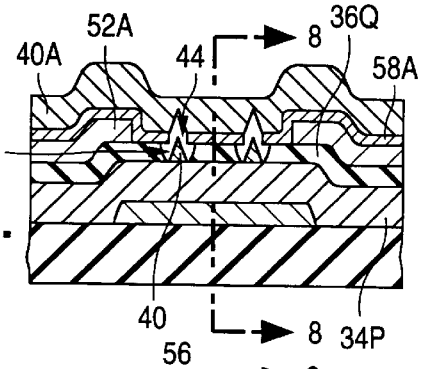

Electron-emissive cones 40 are now formed in composite openings 42/44. Various techniques can be employed to create cones 40. In one technique, the desired emitter cone material, typically molybdenum, is evaporatively deposited on top of the structure in a direction generally perpendicular to the upper surface of faceplate 30. The emitter cone material accumulates on gate layer 58A and passes through gate openings 44 to accumulate on resistive layer 34P in composite openings 42/44. Due to the accumulation of the cone material on gate layer 58A, the openings through which the cone material enters openings 42/44 progressively close. The deposition is performed until these openings fully close. As a result, the cone material accumulates in openings 42/44 to form corresponding conical electron-emissive elements 40 as shown in FIGS. 8*h* and 9*h*. A continuous (blanket) layer 40A of excess emitter cone material is simultaneously formed on gate layer 58A.

Figure 8I:
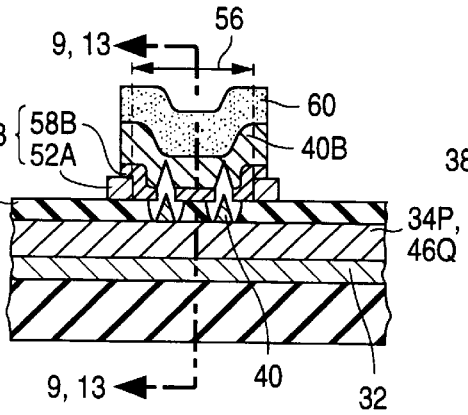
Figure 9I:
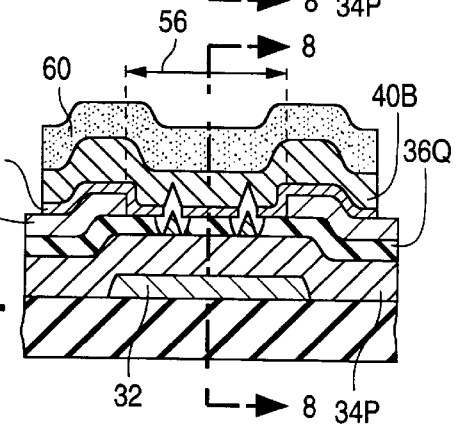

A photoresist mask 60 bearing a pattern that at least covers main control openings 56 is formed on top of the structure. See FIGS. 8*i* and 9*i*. In the example of FIGS. 8*i* and 9*i*, the solid portions of photoresist 60 are wider than emitter electrodes 32 in the column direction (FIG. 9*i*) but are narrower than main control portions 52A in the row direction (FIG. 8*i*).

The exposed material of excess emitter-material layer 40A is removed, typically with a liquid chemical etchant. When excess layer 40A consists of molybdenum, the chemical etchant is typically formed with phosphoric, nitric, and acetic acids. The remaining portions 40B of excess layer 40A fully overlie main control openings 56. In particular, each excess emitter-material portion 40B typically overlies a single one of openings 56. Excess portions 40B are normally rectangular in shape as viewed perpendicular to the upper surface of baseplate 30.

In subsequent etching steps, part of the pattern of photoresist 60 is to be transferred to gate layer 58A, dielectric layer 36Q, and resistive layer 34P. Since the pattern of photoresist 60 is now present in excess emitter-material portions 40B, photoresist 60 can be removed at this point, or later, depending on the constituency of excess portions 40B, on the constituency of layers 58A, 36Q, and 34P, and on the etchants and etch techniques utilized to etch layers 58A, 36Q, and 34P. Nevertheless, photoresist 60 is typically left in place at this point.

Using photoresist 60 and excess portions 40B as an etch mask, the exposed portions of gate layer 58A are removed, typically with a plasma etchant. When gate layer 58A consists of chromium, the plasma is typically formed with chlorine and oxygen. Items 58B in FIGS. 8*i* and 9*i* are the remaining portions of gate layer 58A. Since the illustrated portions of photoresist 60 are narrower than main control portions 52A in the row direction, control portions 52A extend laterally outward beyond gate portions 58B in the row direction. Each control electrode 38 is formed by the combination of one main control portion 52A and the adjoining gate portions 58B.

With photoresist 60 still in place, the exposed portions of dielectric layer 36Q are removed with a suitable etchant using the combination of photoresist 60, excess emitter-material portions 40B, and control electrodes 38 (i.e., main control portions 52A and gate portions 58B) as an etch mask. In particular, the column-direction edges of control electrodes 38 provide masking edges so that the portions of dielectric layer 36Q situated below the spaces between electrodes 38 are removed. See FIGS. 8*j* and 9*j* in which dielectric strips 36 constitute the patterned remainder of dielectric layer 36Q. Photoresist 60 and excess emitter-material portions 40B prevent the etchant from attacking the segments of dielectric strips 36 at the bottoms of dielectric openings 42. The etchant is typically a plasma. When dielectric layer 36Q consists of silicon oxide, the plasma is typically formed with fluorine and oxygen.

Figure 8K:
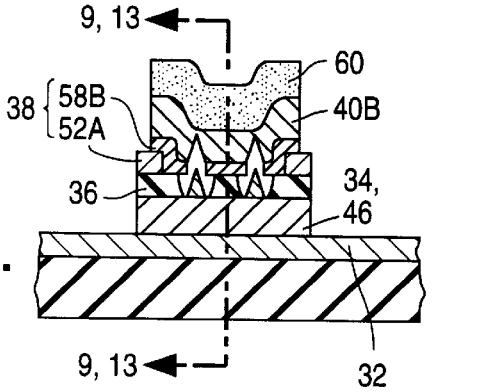
Figure 9K:
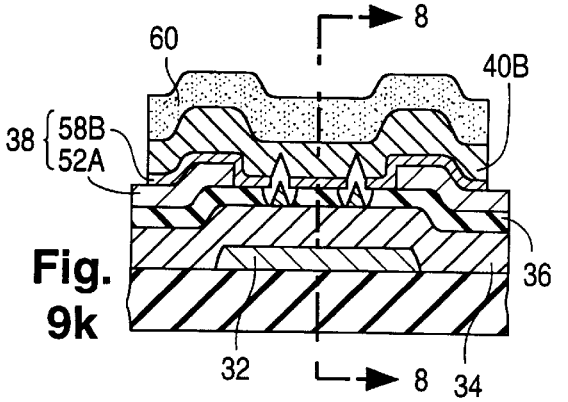

Photoresist 60 continues to remain in place. Using the combination of photoresist 60, excess emitter-material portions 40B, control electrodes 38, and dielectric strips 36 as an etch mask, the exposed portions of resistive layer 34P are removed. Again, the column-direction edges of control electrodes 38 provide masking edges. Accordingly, the portions of resistive layer 34P situated below the spaces between electrodes 38 are removed as shown in FIGS. 8*k* and 9*k*. Resistive strips 34 now constitute the patterned remainder of resistive layer 34P.

The patterning of resistive layer 34P to form strips 34 is typically performed with one or more plasma etchants depending on the constituency of layer 34P. When layer 34P consists of an upper cermet layer and a lower silicon-carbon-nitrogen layer, the cermet is typically etched with a plasma formed with fluorine and oxygen. Chlorine may also be used in forming the plasma used to etch the upper cermet layer. The silicon-carbon-nitrogen compound in the lower layer is typically etched with a plasma formed with fluorine and oxygen.

Photoresist mask 60 has open spaces at locations in the peripheral device region where emitter electrodes 32 (and main control portions 52A) are to be externally electrically accessed for receiving electrical signals during field emitter operation. As portions of layers 40A, 58A, 36Q, and 34P are removed in the active device region to produce regions 40B, 58B, 36, and 34, portions of layers 40A, 58A, 36Q, and 34P are simultaneously removed in the peripheral region to expose the contact pad locations where electrodes 32 are later electrically accessed along their top surfaces. In this way, external electrical contacts are made to the top surfaces of electrodes 32 without performing a separate etch step to cut contact openings through resistive layer 34P, thereby avoiding an additional masking operation.

Photoresist 60 is now removed (if not removed earlier). Excess emitter-material portions 40B are also to be removed. However, excess portions 40B furnish some protection to electron-emission elements 40. Advantage can be taken of this to perform additional processing on the partially finished field emitter before removing portions 40B.

For example, a base focusing structure 62 of an electron focusing system can be formed on part of the field-emission structure not covered by excess emitter-material portions 40B. See FIGS. 8*l* and 9*l*. Base focusing structure 62 is generally arranged in a waffle-like pattern as viewed perpendicularly to the upper surface of baseplate 30. Structure 62 typically consists of electrically resistive and/or electrically insulating material.

Excess emitter-material portions 40B are now removed, typically according to the electrochemical technique described in Knall et al, U.S. patent application Ser. No. 08/884,700, filed Jun. 30, 1997, now U.S. Pat. No. 5,893,967. See FIGS. 8*m* and 9*m*. Alternatively, a lift-off technique can be employed to remove excess portions 40B. In that case, a lift-off layer is provided on top of gate layer 58A at the stage shown in FIGS. 8*g* and 9*g* before deposition of the emitter cone material. The lift-off layer is removed at the stage shown in FIGS. 8*m* and 9*m* so as to simultaneously remove excess portions 40B.

Finally, the electron focusing system is completed by providing base focusing structure 62 with an electrically non-insulating focus coating 64 that lies on the top surface of structure 62 and extends partially down its sidewalls. Focus coating 64 can also be created before removing portions 40B. In any event, electrons emitted by electron-emissive elements 40 are focused by system 62/64 so as to impinge on desired light-emitting elements in the light-emitting device situated opposite the field emitter of FIGS. 8*m* and 9*m*.

The process of FIGS. 8 and 9 can be modified in various ways. For example, emitter layer 32P can be formed as a lower aluminum (or aluminum alloy) layer and a thin upper tantalum layer created by sputter depositing tantalum. After patterning layer 32P to form emitter electrodes 32, thin layers of metal oxide can be anodically formed along the sidewalls of electrodes 32. Alternatively, tantalum can be deposited on the aluminum (alloy) of electrodes 32 after patterning emitter layer 32P. The excess tantalum situated in the spaces between the intended locations for electrodes 32 is then removed with an etchant using a suitable photoresist mask. Each emitter electrode 32 then consists of an aluminum (alloy) electrode whose top surface and sidewalls are covered with tantalum. Main control portions 52A can be handled in a similar manner so as to consist of aluminum (alloy) electrodes having tantalum coatings on their top surfaces and either tantalum or anodically formed metal oxide on their sidewalls.

Figure 10A:
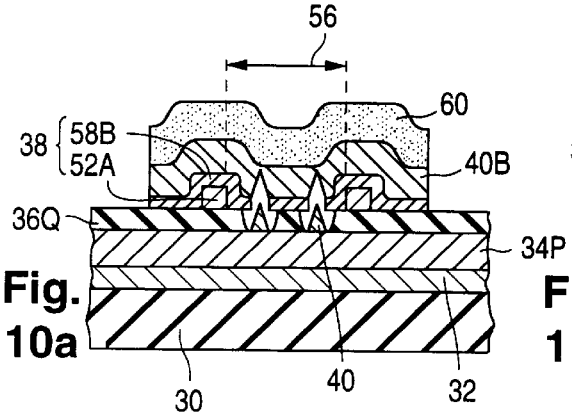
FIGS. 10*a* and 10*b* are cross-sectional structural views representing a set of steps that can be substituted for those represented by FIGS. 8*i* and 8*m*.
Figure 10B:
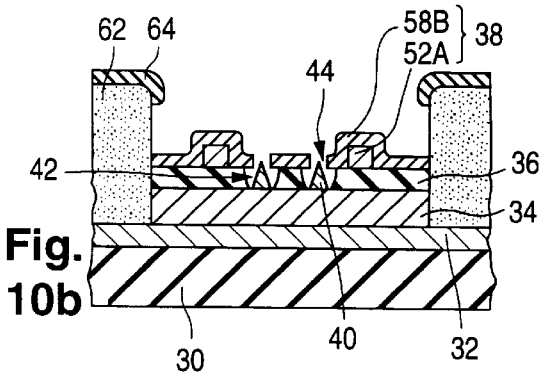

FIGS. 10*a* and 10*b* present a variation to the process of FIGS. 8 and 9 for which, in the row direction, the illustrated part of photoresist 60 is wider than underlying main control portion 52A. FIG. 10*a* illustrates a cross section corresponding to that of FIG. 8*i* at which gate layer 58A is patterned using photoresist 60 and excess emitter-material portions 40B as an etch mask in forming gate portions 58B. Even though gate portions 58B are wider than main control portion 52A in FIG. 10*a*, the edges of control electrode 38 serve as masking edges in patterning layers 36Q and 34P to respectively form strips 36 and 34. The longitudinal side edges of each control electrode 38 are again in approximate vertical alignment with both the longitudinal side edges of underlying dielectric strip 36 and the longitudinal side edges of underlying resistive strip 34. FIG. 10*n* illustrates a cross section corresponding to the final cross section of FIG. 8*m*.

Figure 11A:
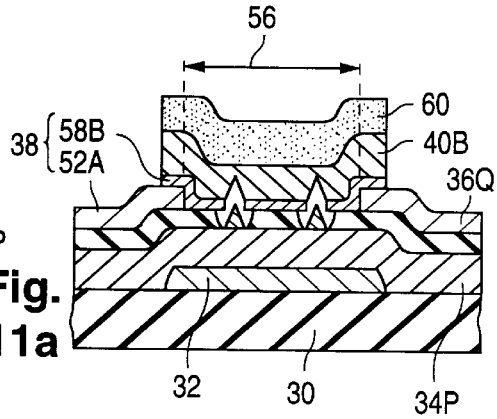
FIGS. 11*a* and 11*b* are cross-sectional structural views representing a set of steps that can be substituted for those represented by FIGS. 9*i* and 9*m*.
Figure 11B:
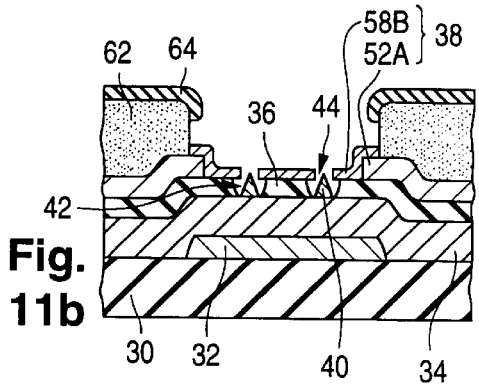

FIGS. 11*a* and 11*b* present a variation to the process of FIGS. 8 and 9 for which the illustrated part of photoresist 60 is narrower in the column direction than underlying emitter electrode 32. FIG. 11*a* illustrates a cross section corresponding to that of FIG. 9*i* at which gate layer 58A is patterned to create gate portions 58B. FIG. 11*b* illustrates a cross section corresponding to the final cross section of FIG. 9*m*.

FIGS. 12*a*–12*c* and 13*a*–13*m* in combination with FIGS. 8*d*–8*m* illustrate a process for making an embodiment of the field emitter of FIGS. 5–7. The structure shown in each FIG. 13*x*, for x varying from a to c, is taken through a plane perpendicular to the structure shown in corresponding FIG. 12*x*. The structure shown in each FIG. 13*x*, for x varying from d to m, is taken through a plane perpendicular to the structure shown in corresponding FIG. 8*x*. The cross sections of FIGS. 12*a*–12*c* and 8*d*–8*m* (collectively "FIG. 12/8") lead to an embodiment of the cross section of FIG. 5. The cross sections of FIGS. 13*a*–13*m* (collectively "FIG. 13") lead to an embodiment of the cross section of FIG. 6.

Figure 12A:
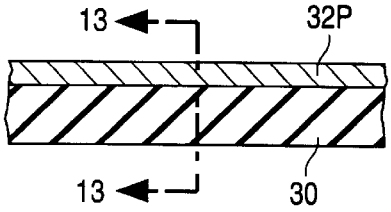
FIGS. 12*a*–12*c* are cross-sectional structural views representing part of the steps in manufacturing an embodiment of the electron-emitting device of FIGS. 5–7 according to the invention.
Figure 13A:
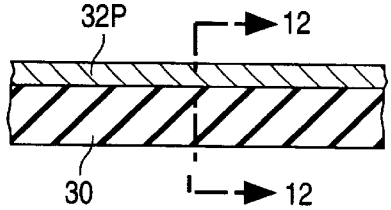
FIGS. 13*a*–13*m* are cross-sectional structural views respectively corresponding to FIGS. 12*a*–12*c* and 8*d*–8*m*.
Figure 12B:
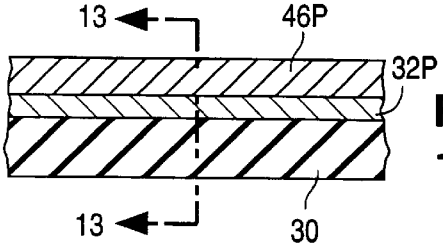
Figure 13B:
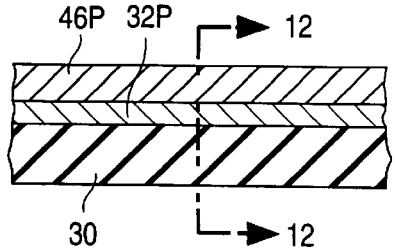

The starting point for the process of FIGS. 12/8 and 13 is baseplate 30 over which emitter layer 32P has been formed in the manner described above. See FIGS. 12*a* and 13*a*. A sputter etch may be performed to clean the top surface of layer 32P. A blanket electrically resistive layer 46P is deposited on emitter layer 32P as shown in FIGS. 12*b* and 13*b*. Resistive layer 46P has the physical characteristics of resistive layer 34P and is formed in the same way as layer 34P.

A photoresist mask 66 bearing the pattern for emitter electrodes 32 is formed on top of resistive layer 46P. See FIGS. 12*c* and 13*c*. As with photoresist mask 50, photoresist mask 60 has sidewalls that slope strongly outward in moving vertically downward. This is achieved by heating photoresist 60 to a temperature above the glass transition point so that photoresist 60 flows.

The exposed material of resistive layer 46P is removed, thereby patterning layer 46P into a group of resistive strips 46Q extending in the row direction respectively above the intended locations for emitter electrodes 32. The removal step is performed in such a manner that resistive strips 46Q have profiles roughly in the shape of upright isosceles trapezoids in vertical planes extending in the column direction. This is typically accomplished by etching the exposed material of layer 46P with etchant that attacks the photoresist of mask 66 at a rate very high relative to the rate at which the etchant attacks the material of layer 46P. Due to the resultant lateral erosion of photoresist 66, resistive strips 46Q are created with the indicated sloped sidewalls.

One or more plasmas are typically utilized to perform the resistive-layer patterning step depending on the constituency of resistive layer 46P. When layer 46P is a bilayer consisting of an upper cermet layer and a lower silicon-carbon-nitrogen layer, the cermet is typically etched with a fluorine/oxygen plasma. Chlorine may also be present in the plasma. The silicon-carbon-nitrogen compound is etched with a fluorine/oxygen plasma.

Figure 12C:
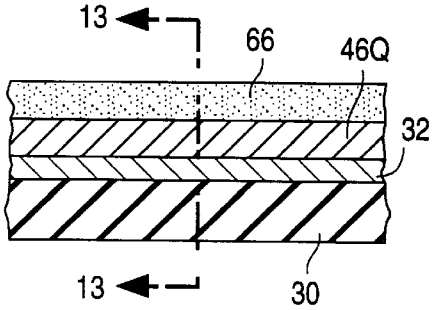
Figure 13C:
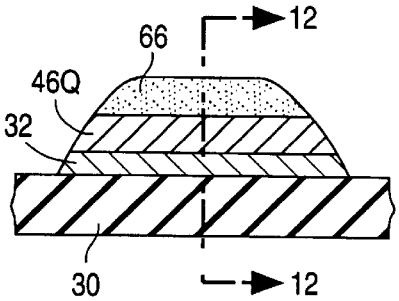

With photoresist 66 still in place, the exposed material of emitter layer 32P is removed. This step is likewise performed in such a way that the remainder of emitter layer 32P constitutes emitter electrodes 32 having upright isosceles trapezoidally shaped profiles in the transverse direction—i.e., the column direction here. The patterning step to create electrodes 32 is performed according to the photoresist-erosion technique described above for the process of FIGS. 8 and 9. FIGS. 12*c* and 13*c* illustrate the photoresist shape at the end of the emitter-electrode patterning step, photoresist 66 having been larger at the beginning of emitter electrode patterning step and even larger at the beginning of the resistive-layer patterning step. Photoresist 66 is subsequently removed.

From here on, the fabrication steps in the process of FIGS. 12/8 and 9 are performed in largely the manner described above for the process of FIGS. 8 and 9, subject to changing resistive layer 34P and resistive strips 34 respectively to resistive strips 46Q and resistive portions 46 in the above description. The row-direction cross sections at the later stages in the process of FIGS. 12/8 and 13 appear largely the same as in the process of FIGS. 8 and 9. With reference symbols 46Q and 46 being used respectively in place of reference symbols 34P and 34, FIGS. 8*d*–8*m* illustrate the subsequent row-direction cross sections for the process of FIGS. 12/8 and 13.

The column-direction cross sections at the later stages in the process of FIGS. 12/8 and 13 appear differently than in the process of FIGS. 8 and 9 because the resistive layer at the stages illustrated in FIGS. 12*c* and 13*c* for the process of FIGS. 12/8 and 13 is patterned into resistive strips 46Q rather than being a blanket layer as is the case with resistive layer 34P at the corresponding stage in the process of FIGS. 8 and 9. Likewise, this results in the final patterned resistor being configured as a two-dimensional array of resistive portions 46 in the process of FIGS. 12/8 and 13 instead of a group of strips as occurs with resistive strips 34 in the process of FIGS. 8 and 9.

Figure 13D:
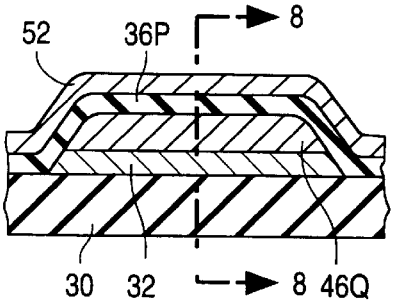
Figure 13F:
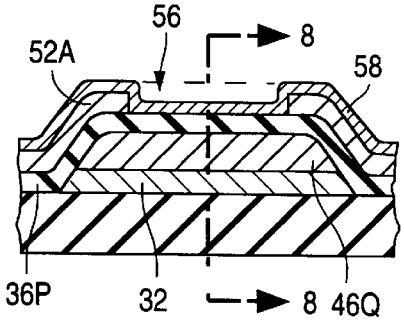
Figure 13E:
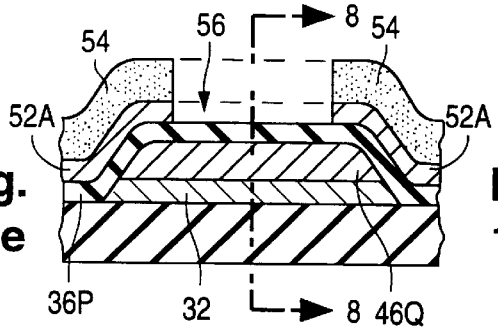

With the foregoing in mind, only a brief description of the remainder of the process of FIGS. 12/8 and 13 is given here. FIGS. 8*d* and 13*d* depict the formation of dielectric layer 36P and main control layer 52, dielectric layer 36P now extending down to baseplate 30 in the spaces between emitter electrodes 32. The patterning of main control layer 52 to produce main control portions 52A is shown in FIGS. 8*e* and 13*e*. FIGS. 8*f* and 13*f* illustrate the deposition of gate layer 58.

Figure 13G:
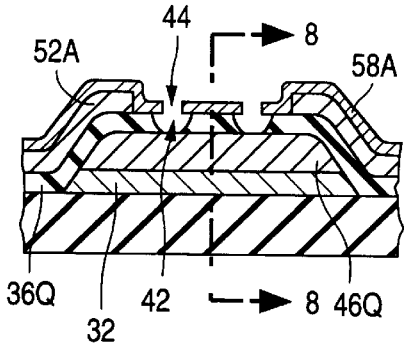
Figure 13H:
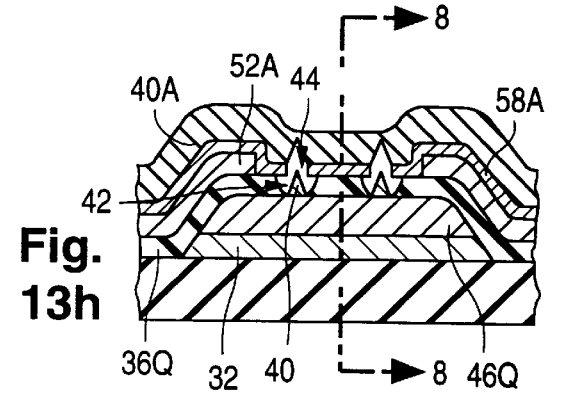

The formation of dielectric openings 42 and gate openings 44 is shown in FIGS. 8*g* and 13*g*. FIGS. 8*h* and 13*h* depict the creation of electron-emissive elements 40 and the deposition of excess emitter-material layer 40A. The patterning of gate layer 58A to form gate portions 58B is shown in FIGS. 8*i* and 13*i*. Each control electrode 38 is again formed with one main control portion 52A and the adjoining gate portions 58B.

Figure 8J:
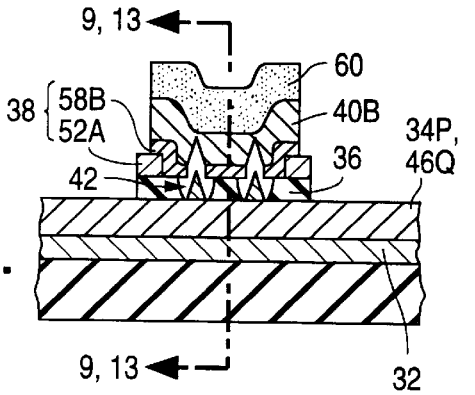
Figure 9J:
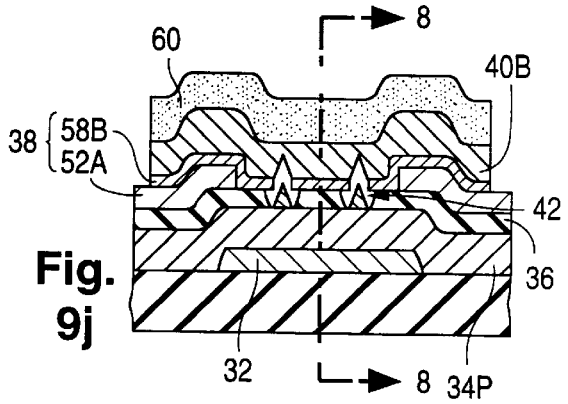
Figure 13L:
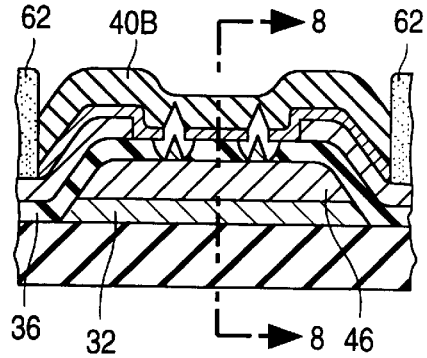
Figure 13I:
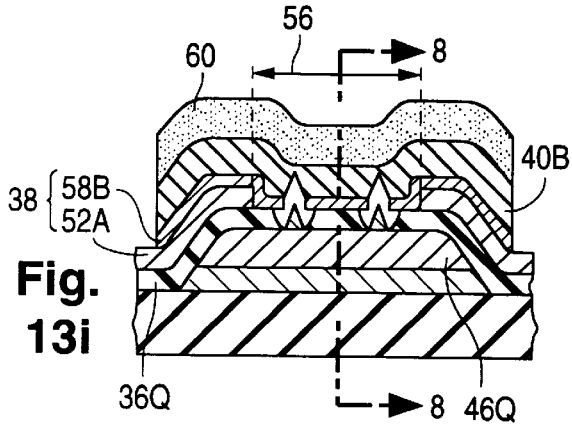
Figure 13M:
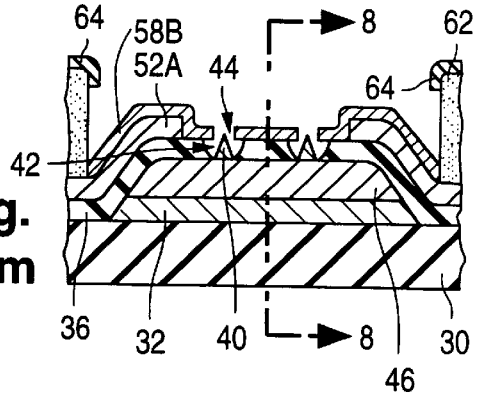
Figure 13J:
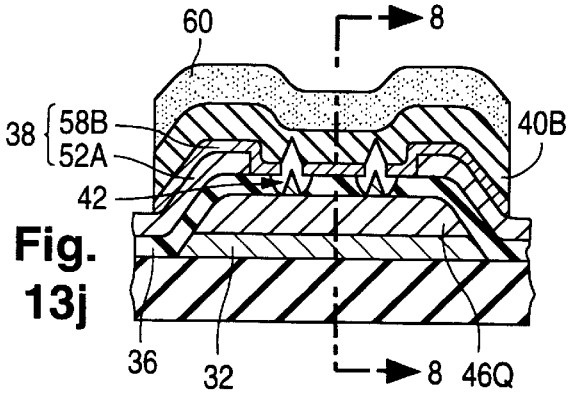
Figure 13K:
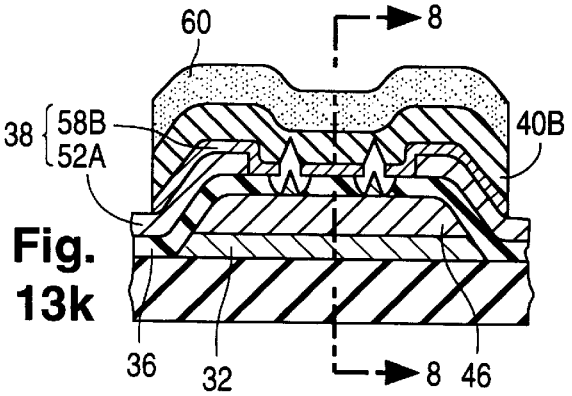

FIGS. 8*j* and 13*j* show the patterning of dielectric layer 36Q to produce dielectric strips 36. The patterning of resistive strips 46Q to form resistive portions 46 is depicted in FIGS. 8*k* and 13*k*. Control electrodes 38 serve as part of the etch mask during the patternings of dielectric layer 36Q and resistive strips 46Q. At this point, the resistive layer consists of the two-dimensional array of resistive portions 46.

As in the process of FIGS. 8 and 9, photoresist mask 60 in the process of FIGS. 12/8 and 13 has open spaces at the peripheral-region sites where emitter electrodes 32 (and main control portions 52A) are to be externally electrically contacted to receive electrical signals during device operation. In the course of removing portions of layers 40A, 58A, and 36Q and resistive strips 46Q in the active region to produce regions 40B, 58B, 36, and 46, portions of layers 40A, 58A, and 36Q and strips 46Q are simultaneously removed in the peripheral region to expose the contact pad locations at the top surfaces of electrodes 32. Again, external electrical contacts can later be made to the top surfaces of electrodes 32 without performing a separate masked etch to cut the contact openings through the resistive layer, here embodied as resistive strips 46Q.

Figure 8L:
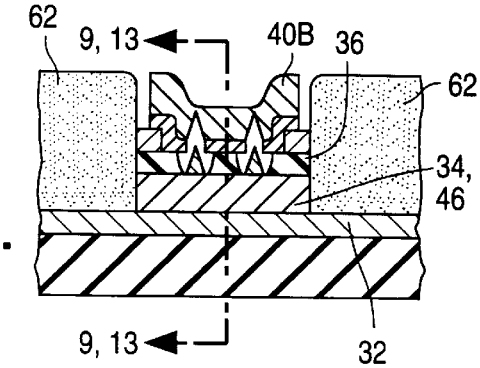
Figure 9L:
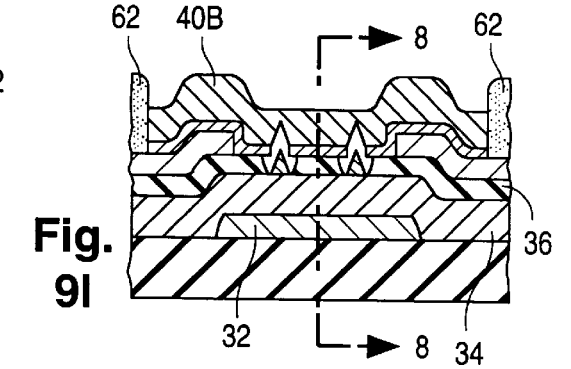
Figure 8M:
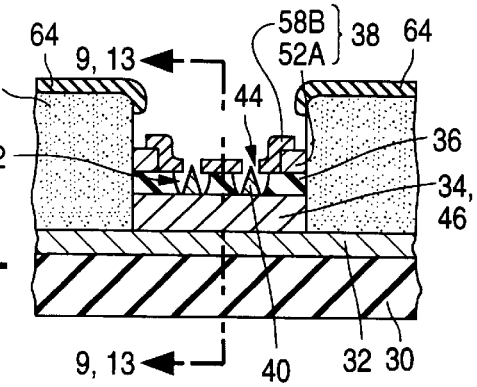
Figure 9M:
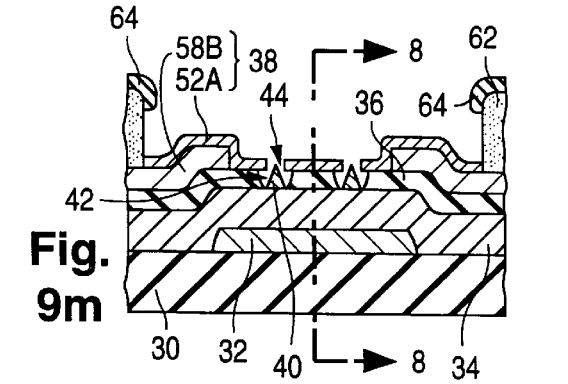

FIGS. 8*l* and 13*l* illustrate the formation of base focusing structure 62. The formation of focus coating 64 and the removal of excess emitter-material portions 40B is shown in FIGS. 8*m* and 13*m*. In the final illustrated structure of FIGS. 8*m* and 13*m*, one of resistive portions 46 is situated at each location where control electrodes 38 (formed with portions 52A and 58B) cross over emitter electrodes 32.

The process of FIGS. 12/8 and 13 can be modified in various ways. Except for the process variation that involves forming tantalum along the sidewalls of emitter electrodes 32, the process variations described above for the process of FIGS. 8 and 9 generally apply to the process of FIGS. 12/8 and 13.

Instead of performing the resistor patterning in the various ways described above, a separate photoresist mask can be utilized for patterning a blanket electrically resistive layer to form resistive strips that are similar to resistive strips 34, or resistive portions that are similar to resistive portions 46. The patterning operation is typically done after patterning emitter layer 32P to form emitter electrodes 32 but, depending on the resistor pattern, can be done before patterning emitter layer 32P. Baking the resistor-patterning photoresist at a temperature above the glass transition point so that the sidewalls of the photoresist flow to a shallow angle is an important part of the resistor patterning operation. The characteristics of the etchant and the photoresist are chosen so that the photoresist has a high etch rate relative to that of the blanket resistive layer. This can be achieved by (a) etching with a plasma, (b) etching in a reactive-ion-etch mode, or (c) using ion milling implemented, for example, with oxygen and argon.

Figure 14:
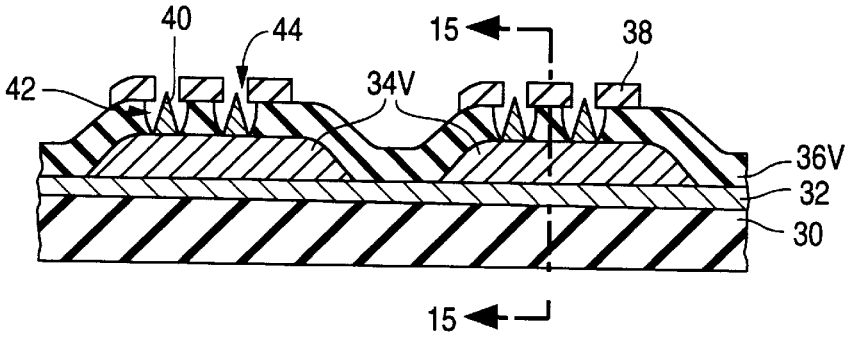
FIGS. 14 and 15 are cross-sectional structural views of the core of an electron-emitting device provided with a further vertical emitter resistor patterned in accordance with the invention. The cross section of FIG. 14 is taken through plane 14—14 in FIG. 15. The cross section of FIG. 15 is taken through plane 15—15 in FIG. 14.
Figure 15:
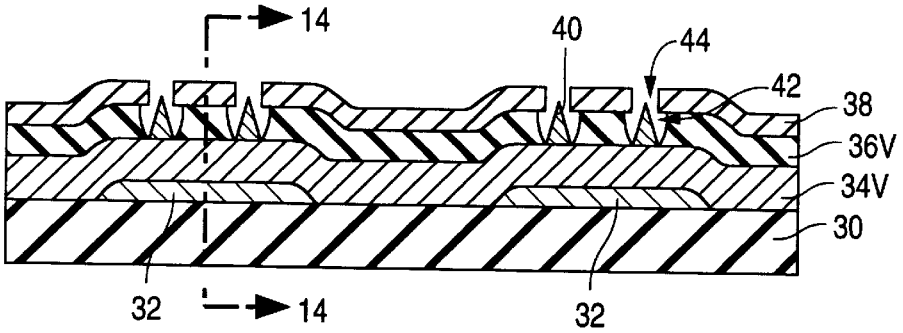

Referring to FIGS. 14 and 15 they illustrate the core of a matrix-addressed field emitter that contains a vertical emitter resistor patterned into a group of laterally separated electrically resistive strips 34V using a separate photoresist mask in accordance with the invention. Except as discussed below, the field emitter of FIGS. 14 and 15 is largely the same as the field emitter of FIGS. 2–4. Resistive strips 34V, which replace resistive strips 34 in the field emitter of FIGS. 2–4, extend in the column direction. In addition to strips 34V, the field emitter of FIGS. 14 and 15 contains components 30, 32, 38, and 40, and an interelectrode dielectric layer 36V which replaces dielectric layer 36 in the field emitter of FIGS. 2–4. The cross sections of FIGS. 14 and 15 respectively correspond to the cross sections of FIGS. 2 and 3 and are taken perpendicular to each other.

Resistive strips 34V in the field emitter of FIGS. 14 and 15 have transverse profiles roughly in the shape of upright isosceles trapezoids. The acute angle in the trapezoids is 5–75°, preferably 15°. Inasmuch as resistive strips 34V are formed using a separate photoresist mask, the longitudinal edges of strips 34V can be laterally offset slightly from the longitudinal edges of control electrodes 38. An example of this offset is depicted in FIG. 14. Due to the point at which the patterning step is performed to create strips 34V, dielectric layer 36V is essentially unpatterned in the active device area rather than being patterned in the active area as is the case with dielectric layer 36 in the field emitter of FIGS. 2–4.

Figure 16:
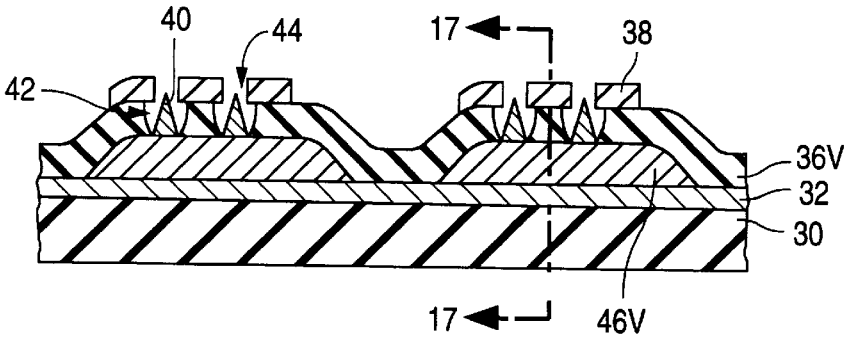
FIGS. 16 and 17 are cross-sectional structural views of the core of an electron-emitting device provided with yet another vertical emitter resistor patterned in accordance with the invention. The cross section of FIG. 16 is taken through plane 16—16 in FIG. 17. The cross section of FIG. 17 is taken through plane 17—17 in FIG. 16.
Figure 17:
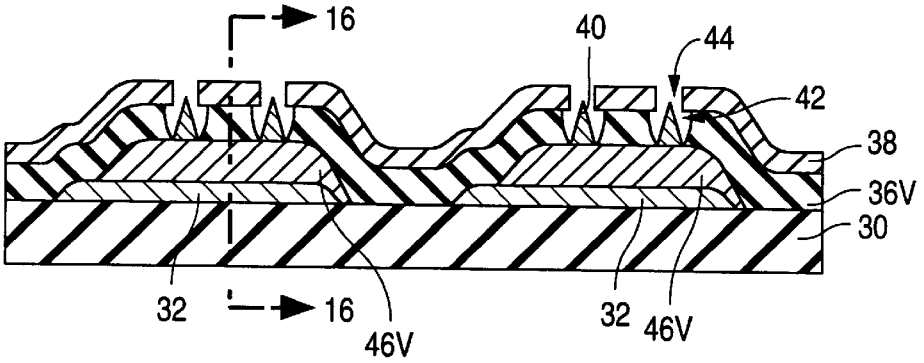

FIGS. 16 and 17 illustrate the core of a matrix-addressed field emitter that contains a vertical emitter resistor patterned into multiple laterally separated electrically resistive portions 46V using a separate photoresist mask in accordance with the invention. Except as discussed below, the field emitter of FIGS. 16 and 17 is largely the same as that of FIGS. 5–7. Resistive portions 46V, which replace resistive portions 46 in the field emitter of FIGS. 5–7, are arranged in a two-dimensional array of rows and columns of portions 46V. In addition to resistive portions 46V, the field emitter of FIGS. 16 and 17 contains components 30, 32, 38, and 40 and dielectric layer 36V. The cross sections of FIGS. 16 and 17 respectively correspond to the cross sections of FIGS. 5 and 6 and are taken perpendicular to each other.

Resistive portions 46V in the field emitter of FIGS. 16 and 17 have profiles roughly in the shape of upright isosceles trapezoids in vertical planes extending in both the row and column directions. See FIGS. 16 and 17. The acute angle in the trapezoids is 5–75°, preferably 15°. Since resistive portions 46V are formed with a separate photoresist mask, the column-direction edges of portions 46V can be laterally offset from the longitudinal edges of control electrodes 38. Likewise, the row-direction edges of portions 46V can be laterally offset from the longitudinal edges of emitter electrodes 32. Examples of these offsets are depicted in FIGS. 16 and 17. Dielectric layer 36V is again essentially unpatterned in the active device area.

The field emitter of FIGS. 14 and 15 or FIGS. 16 and 17 is typically manufactured in the following manner. Emitter layer 32P is deposited on baseplate 30 and patterned using photoresist mask 50 to produce emitter electrodes 32 as in the process of FIGS. 8 and 9. See FIGS. 8*a* and 9*a* and FIGS. 8*b* and 9*b*.

A blanket electrically resistive layer is then formed on top of the structure. Letting resistive layer 34P represent the blanket resistive layer, the structure appears basically as shown in FIGS. 8*c* and 9*c* at this point. The blanket resistive layer is typically a bilayer as described above for resistive layer 34P. Again, the lower resistive layer in the bilayer typically consists of a silicon-carbon-nitrogen compound while the upper resistive layer is typically formed with cermet.

Using a photoresist mask having a pattern corresponding to that of either resistive strips 34V or resistive portions 46V, the blanket resistive layer is patterned to produce resistive sections 34V or 46V. The resistor patterning operation can be performed as described above for patterning resistive layer 34P to produce resistive strips 34.

As resistive sections 34V or 46V are created in the active device region, portions of the resistive layer are simultaneously removed in the peripheral device region to expose the contact pads at the top surfaces of emitter electrodes 32. Once again, the top surfaces of electrodes 32 are exposed at the locations where electrodes 32 are to be externally contacted without performing an extra masked etch.

A blanket dielectric layer corresponding to dielectric layer 36P is deposited on top of the structure. In subsequent operations, control electrodes are formed on top of the blanket dielectric layer, control openings 44 and dielectric openings 42 are formed respectively through the control electrodes and the dielectric layer thereby producing control electrodes 38 and dielectric layer 36D, and electron-emissive elements 40 are formed in composite openings 42/44. Aside from deleting (a) the steps involved in patterning dielectric layer 36Q to form dielectric strips 36 and (b) the steps involved in patterning resistive layer 34P or 46Q to form resistive sections 34 or 46, the subsequent operations can be performed in the manner described above for the process of FIGS. 8 and 9. FIGS. 14 and 15 or 16 and 17 illustrate the final field-emission cathode depending on the pattern created in the photoresist mask used to pattern the resistive layer.

The photoresist mask utilized in defining resistive sections 34V or 46V in the field emitter of FIGS. 14 and 15 or 16 and 17 is normally configured so that portions of the original blanket resistive layer are removed above emitter electrodes 32 in the lateral periphery of the field emitter—i.e., outside the active device area. Likewise, the layers or layer employed in forming control electrodes 38, typically implemented with main control electrodes 52A and gate portions 58B, in the field emitter of FIGS. 2–4 or 5–7 is normally configured so that portions of the original resistive layer are removed above emitter electrodes 32 in the lateral periphery of the field emitter. Consequently, external electrical connections can be made to the upper surface of electrodes 32 in the periphery of each of the four field emitters without cutting through dielectric layer 36 or 36V.

As described above, openings that extend through resistive layer 34P down to the top surfaces of emitter electrodes 32 in the peripheral region of the field emitter made according to the process of FIGS. 8 and 9 can be established by depositing the resistive material(s) using a shadow mask to prevent the resistive material(s) from accumulating at the peripheral-region locations of these openings. By utilizing suitable shadow masking and/or selective etching of materials subsequently deposited to form the remainder of the field emitter, the peripheral-region openings through resistive layer 34P can serve as contact openings for electrically accessing electrodes 32 along their top surfaces during device operation. Typically, dielectric layer 36P is deposited using a shadow mask to prevent the dielectric material from accumulating at the sites of the contact openings.

Contact openings through resistive layer 46P in the process of FIGS. 12/8 and 13 can be formed in the peripheral device region in the same manner as described in the previous paragraph. Likewise, suitable shadow masking and/or selective etching of materials later deposited to form the remainder of the field emitter can be utilized to keep the contact openings open until suitable electrical contacts are made through the contact openings to layer 46P. With contact openings so formed through the periphery of resistive layer 34P or 46Q and the overlying material, there is typically no need to configure the peripheral-region material of photoresist mask 60 so as to enable contact openings to be formed later through resistive layer 34P or resistive strips 46Q.

In some applications, it is desirable for the resistive layer to be of a largely unpatterned, essentially blanket nature in the active device region while contact openings for accessing emitter electrodes 32 extend through the resistive layer down to the top surfaces of electrodes 32 at sites in the peripheral region. This architecture can be achieved by a variation of the process of FIGS. 8 and 9 in which the active-region material of photoresist mask 60 is configured so as to avoid etching dielectric layer 36Q and resistive layer 34P in the active region. The peripheral-region contact openings through resistive layer 34P down to electrodes 32 can then be provided at an earlier point in the fabrication process by using the peripheral-region shadow-masking resistive-material deposition described in the previous paragraph.

Alternatively, the peripheral-region contact openings to the top surfaces of electrodes 32 can be etched through resistive layer 34P using a separate photoresist mask having suitable mask openings in the peripheral region. The masking/etching operation to form the peripheral-region contact openings can be done at various points subsequent to the deposition of resistive layer 34P, including directly after depositing layer 34P. To the extent that any other material overlies the peripheral-region material of layer 34P at the sites for the contact openings, the photoresist mask is formed on top of this additional material. Using the photoresist mask, the contact openings are first etched through the additional material and are then extended through layer 34P. In both of the preceding techniques for creating the peripheral region contact openings, the remainder of the field-emitter fabrication steps are performed largely in the manner specified above for the process of FIGS. 8 and 9.

In other applications, it is adequate for the resistive layer to overlie largely all of the active-region material of emitter electrodes 32 without extending significantly into the spaces between electrodes 32 while contact openings for accessing electrodes 32 extend through the resistive layer down to electrodes 32 at sites in the peripheral region. This resistor design can be achieved by a variation of the process of FIGS. 12/8 and 13 in which the active region material of photoresist mask 60 is again configured to avoid etching dielectric layer 36Q and resistive strips 46Q in the active region. The earlier patterning of emitter layer 32P and resistive layer 46P using photoresist mask 66 to form electrodes 32 and resistive strips 46P is, however, still performed in this process variation. As a result, resistive strips 46Q largely overlie electrodes 32 in the final field emitter.

The peripheral-region contact openings through resistive strips 46Q down to the top surfaces of emitter electrodes 32 are created according to either of the techniques described in the previously mentioned variation to the process of FIGS. 8 and 9. That is, the contact openings can be provided at an earlier point in this variation to the fabrication process of FIGS. 12/8 and 13 by performing the resistive material deposition using the above-described peripheral-region shadow masking at the contact opening sites. Alternatively, a masking/etching operation using a separate photoresist mask having peripheral-region mask openings at the contact opening sites can be done at various points subsequent to defining resistive strips 46Q. Contact openings through strips 46Q and any material overlying the peripheral-region material of strips 46Q are thereby formed at the contact opening sites. The remainder of the field-emitter fabrication is conducted largely in the manner prescribed above for the process of FIGS. 12/8 and 13.

During the manufacture of the field emitter of FIGS. 14 and 15, contact openings for electrically accessing emitter electrodes 32 along their top surfaces are, as also described above, etched through the resistive layer in the peripheral device region at the same time that the resistive layer is patterned in the active device region. In applications where the resistive layer is to be largely unpatterned in the active region but have peripheral-region contact openings to electrodes 32, the photoresist mask employed for patterning the resistive layer is simply configured to largely avoid any active-region patterning. Similarly, in applications where the resistive layer is to consist of strips largely overlying emitter electrodes 32 in the active region, the resistive-layer photoresist is configured so as to avoid removal of resistive material that overlies electrodes 32 in the active region. Subject to performing suitable shadow masking and/or selective etching of materials subsequently deposited to create the remainder of the field emitter, the rest of the field-emitter fabrication is conducted largely in the manner described above in connection with FIGS. 14 and 15.

Figure 18:
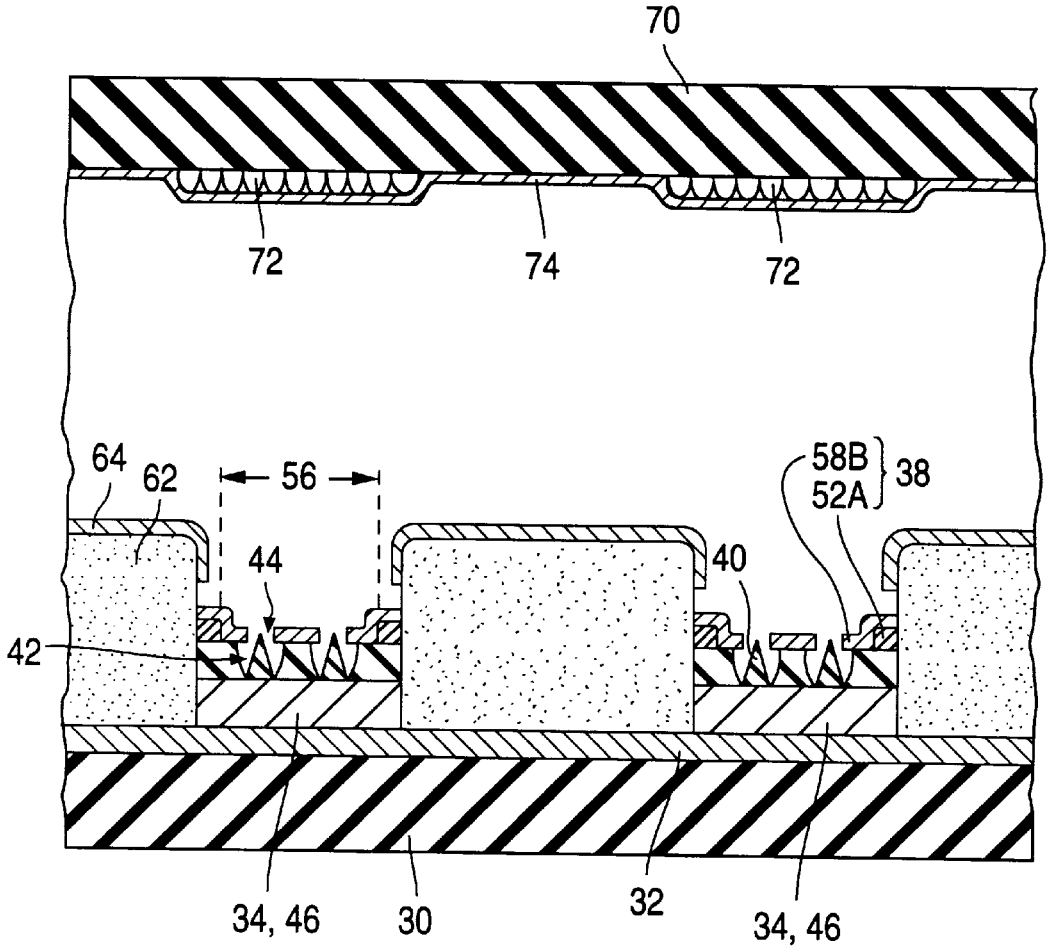
FIG. 18 is a cross-sectional structural view of a flat-panel CRT display that includes a gated field emitter having a patterned emitter resistor configured in accordance with the invention.

FIG. 18 depicts a typical example of the core active region of a flat-panel CRT display that employs an area field emitter, such as that of FIG. 8*m*, manufactured according to the invention. The cross section of FIG. 18 is taken through a vertical plane extending in the row direction. Two resistive sections 34 or 46 are shown in FIG. 18.

A transparent, typically glass, faceplate 70 of a light-emitting device is located across from baseplate 30. Light-emissive phosphor regions 72 are situated on the interior surface of faceplate 70 directly across from corresponding main control apertures 56. A thin electrically conductive light-reflective layer 74, typically aluminum, overlies phosphor regions 72 along the interior surface of faceplate 70. Electrons emitted by electron-emissive elements 40 pass through light-reflective layer 74 and cause phosphor regions 72 to emit light that produces an image visible on the exterior surface of faceplate 70.

The core active region of the flat-panel CRT display typically includes other components not shown in FIG. 18.

For example, a black matrix situated along the interior surface of faceplate 70 typically surrounds each phosphor region 72 to laterally separate it from other phosphor regions 72. Spacer walls are utilized to maintain a relatively constant spacing between baseplate 30 and faceplate 70.

When incorporated into a flat-panel CRT display of the type illustrated in FIG. 18, a field emitter manufactured according to the invention operates in the following way. Light-reflective layer 74 serves as an anode for the field-emission cathode. The anode is maintained at high positive potential relative to electrodes 32 and 38.

When a suitable potential is applied between (a) a selected one of emitter electrodes 32 and (b) a selected one of control electrodes 38, the so-selected gate portion 58B extracts electrons from the electron-emissive elements at the intersection of the two selected electrodes and controls the magnitude of the resulting electron current. Desired levels of electron emission typically occur when the applied gate-to-cathode parallel-plate electric field reaches at least 20 volts/$\mu$m at a current density of 0.1 mA/cm$^2$ as measured at phosphor-coated faceplate 70 when phosphor regions 72 are high-voltage phosphors. Upon being hit by the extracted electrons, phosphor regions 72 emit light.

Directional terms such as "top" and "upper" have been employed in describing the present invention to establish a frame of reference by which the reader can more easily understand how the various parts of the invention fit together. In actual practice, the components of an electron-emitting device may be situated at orientations different from that implied by the directional terms used here. The same applies to the way in which the fabrication steps are performed in the invention. Inasmuch as directional terms are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For instance, resistive layers 34P and 46P can be formed with materials other than cermet and/or silicon-carbon-nitrogen compounds. Examples include amorphous silicon, lightly doped polycrystalline silicon, and other electrically resistive semiconductor materials. Metals different from the ones specified above can be selected for electrodes 32 and 38.

Emitter electrodes 32 can have transverse profiles in shapes other than upright isosceles trapezoids. As an example, the transverse profiles of electrodes 32 can be shaped like rectangles or inverted isosceles trapezoids. The same applies to the transverse profiles of resistive strips 46.

Other patterns in which electrically resistive sections overlie laterally separated parts of each emitter electrode 32 can be employed in place of the patterns provided by resistive sections 34, 34V, 46, and 46V. Additional electrically resistive portions spaced laterally apart from, and created from the same blanket electrically resistive layer as, resistive sections 34, 34V, 46, or 46V can be situated in the spaces between sections 34, 34V, 46, or 46V and/or can be situated outside the active area of the field emitter.

The electron emitters produced according to the invention can be employed to make flat-panel devices other than flat-panel CRT displays. Likewise, the present electron emitters can be used as electron sources in products other than flat-panel devices. Various modifications and applications may thus be made by those skilled in the art without departing from the true scope and spirit of the invention as defined in the appended claims.

We claim:

1. A device comprising:

an emitter electrode;

a patterned electrically resistive layer overlying part of the emitter electrode;

a dielectric layer overlying the resistive layer;

a control electrode overlying the dielectric layer above the resistive layer and having outer lateral edges in approximate vertical alignment with lateral edges of the resistive layer; and an electron-emissive element (a) positioned over the resistive layer above the emitter electrode and (b) situated in a composite opening extending through the control electrode and the dielectric layer.

2. A device as in claim 1 wherein the control electrode comprises a main control portion and a thinner adjoining gate portion that spans a main control opening extending through the main control portion, the composite opening comprising a gate opening that extends through the gate portion at a location generally laterally bounded by the main control opening.

3. A device as in claim 2 wherein:

the emitter electrode extends longitudinally generally in a first lateral direction; and the gate portion is wider than the main control portion in the first direction such that the control electrode's outer lateral edges which are in approximate vertical alignment with the resistive layer's lateral edges comprise outer lateral edges of the gate portion.

4. A device as in claim 2 wherein the gate portion extends over the main control portion.

5. A device as in claim 2 wherein the gate portion extends under the main control portion.

6. A device as in claim 1 wherein the dielectric layer extends laterally beyond the control electrode.

7. A device comprising:

a group of laterally separated emitter electrodes;

a patterned electrically resistive layer overlying parts of the emitter electrodes;

a dielectric layer overlying the resistive layer;

a plurality of laterally separated control electrodes overlying the dielectric layer above the resistive layer and having outer lateral edges in approximate vertical alignment with lateral edges of the resistive layer; and a multiplicity of electron-emissive elements (a) positioned over the resistive layer above the emitter electrodes and (b) situated in composite openings extending through the control electrodes and the dielectric layer.

8. A device as in claim 7 wherein the dielectric layer has lateral edges in approximate vertical alignment with the outer lateral edges of the control electrodes.

9. A device as in claim 7 wherein the resistive layer comprises a plurality of laterally separated resistive strips, each extending continuously over at least two of the emitter electrodes.

10. A device as in claim 7 wherein the resistive layer comprises a plurality of laterally separated resistive strips, each extending continuously over all of the emitter electrodes.

11. A device as in claim 7 wherein the resistive layer comprises a plural number of laterally separated resistive portions, each substantially overlying only one of the emitter electrodes.

12. A device as in claim 11 wherein a different one of the resistive portions overlies each emitter electrode at each different location where one of the control electrodes crosses over that emitter electrode.

13. A device as in claim 7 divided into (a) an active device region which contains the electron-emissive elements and (b) a peripheral device region in which contact openings extend through the resistive layer down substantially to the emitter electrodes.

14. A device as in claim 7 wherein the resistive layer comprises:

a lower layer consisting primarily of first electrically resistive material; and an upper layer overlying the lower layer and consisting primarily of second electrically resistive material different from the first resistive material.

15. A device as in claim 7 wherein material of the dielectric layer underlying at least one of the control electrodes is continuous with material of the dielectric layer underlying at least one other of the control electrodes.

16. A device as in claim 7 wherein:

the electron-emissive elements are situated in an active region of the device; and material of the dielectric layer underlying each control electrode is, in the active region, continuous with material of the dielectric layer underlying each other control electrode.

17. A device comprising:

an emitter electrode having opposing first and second outer lateral edges;

a plurality of laterally separated electrically resistive sections overlying parts of the emitter electrode, each resistive section extending laterally substantially continuously from at least a location largely above the emitter electrode's first outer lateral edge to at least a location largely above the emitter electrode's second outer lateral edge;

a dielectric layer overlying the resistive sections;

a plurality of laterally separated control electrodes extending over the dielectric layer above the resistive sections; and a multiplicity of electron-emissive elements (a) positioned over the resistive sections above the emitter electrodes, (b) situated in composite openings extending through the control electrodes and the dielectric layer, and (c) allocated into a plurality of laterally separated sets, each comprising multiple electron-emissive elements that overlie a different corresponding one of the resistive sections.

18. A device as in claim 17 wherein the resistive sections have lateral edges in approximate vertical alignment with outer lateral edges of the control electrodes.

19. A device as in claim 17 further including:

an additional emitter electrode laterally separated from the other emitter electrode, the resistive sections comprising laterally separated resistive strips that extend over parts of each emitter electrode; and a multiplicity of additional electron-emissive elements (a) positioned over the resistive strips above the additional emitter electrode, (b) situated in composite openings extending through the control electrodes and the dielectric layer, and (c) allocated into a plurality of laterally separated sets, each comprising multiple additional electron-emissive elements that overlie a different corresponding one of the resistive strips.

20. A device as in claim 17 further including:

an additional emitter electrode laterally separated from the other emitter electrode;

a plurality of additional laterally separated resistive sections extending over parts of the additional emitter electrode, the dielectric layer overlying the additional resistive sections, the control electrodes extending over the dielectric layer above the additional resistive sections; and a multiplicity of additional electron-emissive elements (a) positioned over the additional resistive sections above the additional emitter electrode, (b) situated in composite openings extending through the control electrodes and the dielectric layer, and (c) allocated into a plurality of laterally separated sets, each comprising multiple additional electron-emissive elements that overlie different corresponding ones of the additional resistive sections, the resistive sections forming a two-dimensional array of laterally separated resistive portions.

21. A device as in claim 17 wherein each resistive section comprises:

a lower section consisting primarily of first electrically resistive material; and an upper section overlying the lower section and consisting primarily of second electrically resistive material different from the first resistive material.

22. A device as in claim 21 wherein:

the first resistive material comprises a compound containing silicon and carbon; and the second resistive material comprises cermet.

23. A device as in claim 17 wherein the dielectric layer has lateral edges in approximate vertical alignment with outer lateral edges of the control electrodes.

24. A device as in claim 17 wherein material of the dielectric layer underlying at least one of the control electrodes is continuous with material of the dielectric layer underlying at least one other of the control electrodes.

25. A device as in claim 17 wherein:

the electron-emissive elements are situated in an active region of the device; and material of the dielectric layer underlying each control electrode is, in the active region, continuous with material of the dielectric layer underlying each other control electrode.

26. A device as in claim 17 wherein:

the emitter electrode extends longitudinally generally in a first lateral direction; and each resistive section underlies a different corresponding one of the control electrodes and extends laterally beyond the corresponding control electrode in the first direction.

27. A device as in claim 26 wherein each control electrode comprises a main control portion and at least one thinner adjoining gate portion, the gate portions spanning main control openings that extend through the main control portions, part of each composite opening being a gate opening that extends through one of the gate portions at a location generally laterally bounded by one of the main control openings.

28. A device as in claim 17 wherein each control electrode comprises a main control portion and at least one thinner adjoining gate portion, the gate portions spanning main control openings that extend through the main control portions, part of each composite opening being a gate opening that extends through one of the gate portions at a location generally laterally bounded by one of the main control openings.

29. A device as in claim 28 wherein each gate portion extends over an adjoining one of the main control portions.

30. A device as in claim 28 wherein each gate portion extends under an adjoining one of the main control portions.

31. A device comprising:

a group of laterally separated emitter electrodes;

a plurality of laterally separated electrically resistive strips, each extending over at least two of the emitter electrodes;

a dielectric layer overlying the resistive strips;

a plurality of laterally separated control electrodes extending over the dielectric layer above the resistive strips; and a multiplicity of electron-emissive elements (a) positioned over the resistive strips above the emitter electrodes and (b) situated in composite openings extending through the control electrodes and the dielectric layer.

32. A device as in claim 31 wherein each resistive strip extends over all of the emitter electrodes.

33. A device as in claim 31 wherein each control electrode overlies a different corresponding one of the resistive strips.

34. A device as in claim 33 wherein each control electrode overlies largely all of the corresponding resistive strip.

35. A device as in claim 33 wherein each resistive strip extends over all of the emitter electrodes.

36. A device as in claim 31 wherein the electron-emissive elements are allocated into a plural number of laterally separated sets, each comprising multiple electron-emissive elements, at least two of the sets overlying each resistive strip.

37. A device as in claim 31 wherein:

the emitter electrodes extend longitudinally generally in a first lateral direction; and each resistive strip underlies a different corresponding one of the control electrodes and extends laterally beyond the corresponding control electrode in the first direction.

38. A device as in claim 37 wherein each control electrode comprises a main control portion and at least one thinner adjoining gate portion, the gate portions spanning main control openings that extend through the main control portions, part of each composite opening being a gate opening that extends through one of the gate portions at a location generally laterally bounded by one of the main control openings.

39. A device as in claim 31 wherein each control electrode comprises a main control portion and at least one thinner adjoining gate portion, the gate portions spanning main control openings that extend through the main control portions, part of each composite opening being a gate opening that extends through one of the gate portions at a location generally laterally bounded by one of the main control openings.

40. A device as in claim 39 wherein each gate portion extends over an adjoining one of the main control portions.

41. A device as in claim 39 wherein each gate portion extends under an adjoining one of the main control portions.

42. A device comprising:

a group of laterally separated emitter electrodes, each having opposing first and second outer lateral edges;

a plural number of laterally separated electrically resistive portions, each overlying part of one of the emitter electrodes and extending laterally substantially continuously from at least at a location largely above that emitter electrode's first outer lateral edge to at least a location largely above that emitter electrode's second outer lateral edge;

a dielectric layer overlying the resistive portions;

a plurality of laterally separated control electrodes overlying the dielectric layer; and a multiplicity of electron-emissive elements (a) positioned over the resistive portions, (b) situated in composite openings extending through the control electrodes and the dielectric layer, and (c) allocated into a plural number of laterally separated sets, each comprising multiple electron-emissive elements that overlie a different corresponding one of the resistive portions.

43. A device as in claim 42 wherein each control electrode overlies at least two of the resistive portions.

44. A device as in claim 42 wherein each control electrode overlies largely all of each of at least two of the resistive portions.

45. A device as in claim 44 wherein each control electrode has outer lateral edges in approximate vertical alignment with lateral edges of each underlying resistive portion.

46. A device as in claim 42 wherein at least two of the resistive portions overlie each emitter electrode.

47. A device as in claim 46 wherein each emitter electrode has outer lateral edges in approximate vertical alignment with lateral edges of each overlying resistive portion.

48. A device as in claim 42 wherein:

the emitter electrodes extend longitudinally generally in a first lateral direction; and each resistive portion underlies a different corresponding one of the control electrodes and extends laterally beyond the corresponding control electrode in the first direction.

49. A device comprising:

a group of laterally separated emitter electrodes;

an electrically resistive layer overlying the emitter electrodes;

a dielectric layer overlying the resistive layer;

a plurality of laterally separated control electrodes overlying the dielectric layer above the resistive layer; and a multiplicity of electron-emissive elements (a1) positioned over the resistive layer above the emitter electrodes and (a2) situated in composite openings extending through the control electrodes and the dielectric layer, the device being divided into (b1) an active device region which contains the electron-emissive elements and (b2) a peripheral device region in which contact openings extend through the resistive layer down substantially to the emitter electrodes.

50. A device as in claim 49 wherein the resistive layer overlies largely all material of each emitter electrode in the active device region.

51. A device as in claim 49 wherein the resistive layer largely constitutes a blanket layer in the active device region.

52. A device as in claim 49 wherein the resistive layer comprises:

a lower layer consisting primarily of first electrically resistive material; and an upper layer overlying the lower layer and consisting primarily of second electrically resistive material different from the first resistive material.

* * * * *